US010367250B2

(12) United States Patent
Chen et al.

(10) Patent No.: US 10,367,250 B2
(45) Date of Patent: Jul. 30, 2019

(54) ANTENNA STRUCTURE AND ELECTRONIC DEVICE INCLUDING THE SAME

(71) Applicant: Samsung Electronics Co., Ltd., Suwon-si, Gyeonggi-do (KR)

(72) Inventors: Kuo Cheng Chen, Suwon-si (KR); You Chieh Chen, Suwon-si (KR); Yoon Jae Lee, Seoul (KR); Soon Ho Hwang, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 169 days.

(21) Appl. No.: 15/295,365

(22) Filed: Oct. 17, 2016

(65) Prior Publication Data

US 2017/0117616 A1 Apr. 27, 2017

(30) Foreign Application Priority Data

Oct. 27, 2015 (KR) ..... 10-2015-0149162

(51) Int. Cl.

| | |
|---|---|
| ***H01Q 1/36*** | (2006.01) |
| ***H01Q 1/24*** | (2006.01) |
| ***H01Q 9/04*** | (2006.01) |
| ***H01Q 1/22*** | (2006.01) |
| ***H01Q 9/42*** | (2006.01) |

(52) U.S. Cl.

CPC ..... *H01Q 1/243* (2013.01); *H01Q 1/2291* (2013.01); *H01Q 1/24* (2013.01); *H01Q 1/36* (2013.01); *H01Q 9/04* (2013.01); *H01Q 9/0421* (2013.01); *H01Q 9/42* (2013.01)

(58) Field of Classification Search

CPC ..... H01Q 1/243; H01Q 9/0421; H01Q 1/24; H01Q 1/36; H01Q 9/42; H01Q 1/2291; H01Q 9/04

USPC ..... 343/702

See application file for complete search history.

(56) References Cited

U.S. PATENT DOCUMENTS

| | | | | |
|---|---|---|---|---|
| 8,054,231 | B2 | 11/2011 | Ahn et al. | |
| 9,048,538 | B2 | 6/2015 | Sung et al. | |
| 2009/0278757 | A1 | 11/2009 | Ahn et al. | |
| 2012/0009983 | A1* | 1/2012 | Mow | H01Q 1/243 455/575.7 |
| 2012/0229347 | A1* | 9/2012 | Jin | H01Q 1/243 343/702 |

(Continued)

FOREIGN PATENT DOCUMENTS

KR 10-2009-0116030 A 11/2009

*Primary Examiner* — Hai V Tran

(74) *Attorney, Agent, or Firm* — Jefferson IP Law, LLP

(57) ABSTRACT

An electronic device is provided. The electronic device includes a housing and an antenna radiator disposed in the housing. An opening is formed in the housing. The opening includes a first portion configured to align with a length direction of the antenna radiator at a position corresponding to the antenna radiator and penetrate the housing in a thickness direction, and a second portion connected to the first portion, the second portion being configured to form a specified angle with respect to the length direction of the antenna radiator and penetrate the housing in a thickness direction. At least a portion of the housing, which surrounds the opening, comprises a conductive member. At least a portion of a circumference of the opening comprises an electrical open curve.

20 Claims, 20 Drawing Sheets

(56) References Cited

U.S. PATENT DOCUMENTS

| | | | | |
|---|---|---|---|---|
| 2013/0050026 | A1* | 2/2013 | Vin | H01Q 1/22 343/700 MS |
| 2014/0009352 | A1 | 1/2014 | Sung et al. | |
| 2015/0009077 | A1* | 1/2015 | Lee | H01Q 1/243 343/702 |
| 2015/0366110 | A1* | 12/2015 | Park | H04M 1/0264 348/373 |
| 2017/0047647 | A1* | 2/2017 | Jung | H01Q 1/273 |
| 2017/0048991 | A1* | 2/2017 | Kim | H01Q 1/273 |

* cited by examiner

ANTENNA STRUCTURE AND ELECTRONIC DEVICE INCLUDING THE SAME

CROSS-REFERENCE TO RELATED APPLICATION(S)

This application claims the benefit under 35 U.S.C. § 119(a) of a Korean patent application filed on Oct. 27, 2015 in the Korean Intellectual Property Office and assigned Serial number 10-2015-0149162, the entire disclosure of which is hereby incorporated by reference.

TECHNICAL FIELD

The present disclosure relates to an antenna structure using at least a portion of an external housing as an antenna radiator and an electronic device including the same.

BACKGROUND

An electronic device having a communication function may provide mobile communication service by using an antenna. For example, an antenna may be disposed in a partial area of the inside and/or outside of an electronic device housing.

In general, an antenna disposed on an electronic device may be divided into an external antenna and a built-in antenna according to a mounting position. The external antenna has an omni-directional radiation characteristic due to the feature of protruding toward the outside, but has a high breakage concern due to an external impact and is very inconvenient in carrying. Furthermore it may be difficult to design a highly aesthetic appearance of a terminal. Accordingly, today, instead of the external antenna, a built-in antenna mounted inside a portable electronic device is widely used.

An antenna may be located at the inside of an electronic device and an external housing may be formed of metallic frames. For example, as signals transmitted from an antenna disposed inside an electronic device to the outside are partly distorted or blocked due to a metallic frame, antenna radiation performance may be deteriorated.

The housing inside space of an electronic device where an antenna is to be mounted may be limited and, if an electronic device becomes more minimized, may be further limited. When frequency bands supported by an antenna are various, since a plurality of antennas or a complex antenna is required to be disposed, a housing inside space may be further limited.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna structure using at least a portion of an external housing as an antenna radiator and an electronic device including the same.

In accordance with an aspect of the present disclosure, an electronic device is provided. The electronic device includes a housing and an antenna radiator disposed in the housing.

An opening is formed in the housing. The opening includes a first portion configured to align with a length direction of the antenna radiator at a position corresponding to the antenna radiator and penetrate the housing in a thickness direction, and a second portion connected to the first portion, the second portion being configured to form a specified angle with respect to the length direction of the antenna radiator and penetrate the housing in a thickness direction. At least a portion of the housing, which surrounds the opening, comprises a conductive member. At least a portion of a circumference of the opening comprises an electrical open curve.

In accordance with another aspect of the present disclosure, an electronic device is provided. The electronic device includes an external housing including a first surface and a second surface facing an opposite direction of the first surface, a conductive member forming at least a portion of the first surface of the external housing, an antenna radiator disposed in the external housing and spaced apart from the conductive member, and an opening formed by penetrating at least a portion of the conductive member. The opening includes a first portion configured to substantially align with at least a portion of the antenna radiator and a second portion configured to be substantially perpendicular to the first portion. The second portion extends from a portion of the first portion to an adjacency of one of a periphery of the conductive member.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
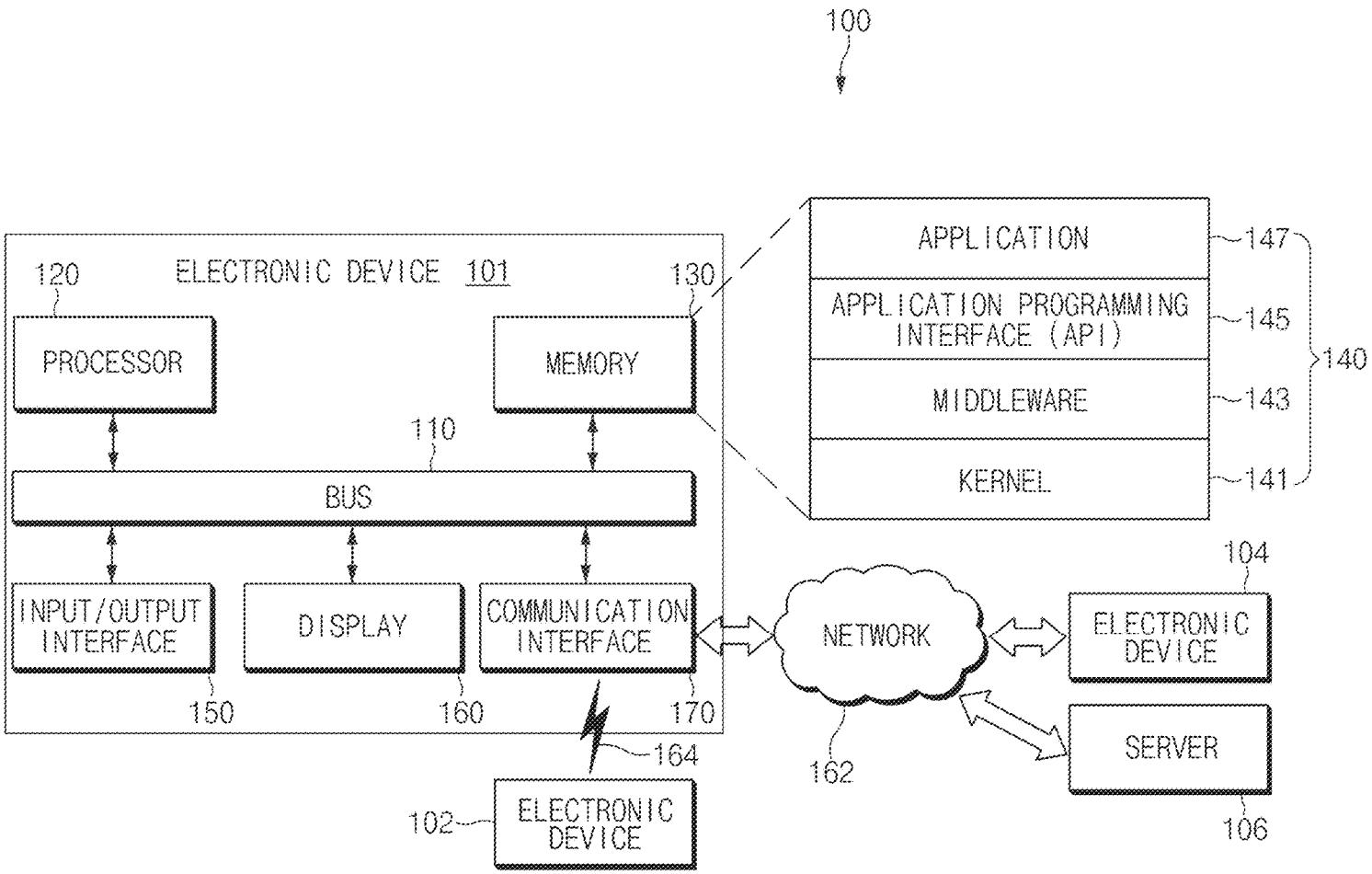
FIG. 1 is a view illustrating an electronic device in a network environment according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The term "include," "comprise," and "have," or "may include," "may comprise," and "may have" used herein indicates disclosed functions, operations, or existence of elements but does not exclude other functions, operations or elements.

For instance, the expression "A or B," or "at least one of A or/and B," may indicate A, B, or both A and B. For instance, the expression "A or B," or "at least one of A or/and B," may indicate (1) at least one A, (2) at least one B, or (3) both at least one A and at least one B.

The terms such as "$1^{st}$," "$2^{nd}$," "first," "second," and the like used herein may refer to modifying various different elements of various embodiments of the present disclosure, but do not limit the elements. For instance, "a first user device" and "a second user device" may indicate different users regardless of the order or the importance. For example, a first component may be referred to as a second component and vice versa without departing from the scope of the present disclosure.

In various embodiments of the present disclosure, it will be understood that when a component (for example, a first component) is referred to as being "(operatively or communicatively) coupled with/to" or "connected to" another component (for example, a second component), the component may be directly connected to the other component or connected through another component (for example, a third component). In various embodiments of the present disclosure, it will be understood that when a component (for example, a first component) is referred to as being "directly connected to" or "directly accesses" another component (for example, a second component), another component (for example, a third component) does not exist between the component (for example, the first component) and the other component (for example, the second component).

The expression "configured to" used in various embodiments of the present disclosure may be interchangeably used with "suitable for," "having the capacity to," "designed to," "adapted to," "made to," or "capable of" according to a situation, for example. The term "configured to" may not necessarily mean "specifically designed to" in terms of hardware. Instead, the expression "a device configured to" in some situations may mean that the device and another device or part are "capable of." For example, "a processor configured to perform A, B, and C" in a phrase may mean a dedicated processor (for example, an embedded processor) for performing a corresponding operation or a generic-purpose processor (for example, a central processing unit (CPU) or application processor (AP)) for performing corresponding operations by executing at least one software program stored in a memory device.

In general, the terms defined in the dictionary should be considered to have the same meaning as the contextual meaning of the related art, and, unless clearly defined herein, should not be understood abnormally or as having an excessively formal meaning. In any cases, even the terms defined in this specification cannot be interpreted as excluding various embodiments of the present disclosure.

According to various embodiments of the present disclosure, electronic devices may include at least one of smartphones, tablet personal computers (PCs), mobile phones, video phones, electronic book (e-book) readers, desktop PCs, laptop PCs, netbook computers, workstation servers, personal digital assistants (PDAs), portable multimedia players (PMPs), moving picture experts group phase 1 or phase 2 (MPEG-1 or MPEG-2) audio layer 3 (MP3) players, mobile medical devices, cameras, and wearable devices. According to various embodiments of the present disclosure, the wearable devices may include at least one of accessory types (e.g., watches, rings, bracelets, anklets, necklaces, glasses, contact lenses, and head-mounted-devices (HMDs)), fabric or garment integrated types (for example, e-apparel), body-mounted types (for example, skin pads and tattoos), and bio-implantation types (for example, implantable circuits).

According to some embodiments of the present disclosure, an electronic device may be a home appliance. The smart home appliances may include at least one of, for example, televisions (TVs), digital versatile disc (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™ and Google TV™), game consoles (for example, Xbox™ and PlayStation™), electronic dictionaries, electronic keys, camcorders, and electronic picture frames.

According to some embodiments of the present disclosure, an electronic device may include at least one of various medical devices supporting call forwarding service (for example, various portable measurement devices (for example, glucometers, heart rate meters, blood pressure meters, temperature meters, etc.), magnetic resonance angiography (MRA) devices, magnetic resonance imaging (MRI) devices, computed tomography (CT) devices, medical imaging devices, ultrasonic devices, etc.), navigation devices, global navigation satellite system (GNSS), event data recorders (EDRs), flight data recorders (FDRs), vehicle infotainment devices, marine electronic equipment (for example, marine navigation systems, gyro compasses, etc.), avionics, security equipment, vehicle head units, industrial or household robots, financial institutions' automatic teller's machines (ATMs), or stores' point of sales (POS) or internet of things (for example, bulbs, various sensors, electric or gas meters, sprinkler systems, fire alarms, thermostats, street lights, toasters, exercise equipment, hot water tanks, heaters, boilers, etc.).

In various embodiments of the present disclosure, an electronic device may include at least one of part of furniture or buildings/structures supporting call forwarding service, electronic boards, electronic signature receiving devices, projectors, and various measuring instruments (for example, water, electricity, gas, and radio signal measuring instruments). An electronic device according to various embodiments of the present disclosure may be one of the above-mentioned various devices or a combination thereof. Additionally, an electronic device according to an embodiment of the present disclosure may be a flexible electronic device. Additionally, an electronic device according to an embodiment of the present disclosure is not limited to the above-mentioned devices and may include a new kind of an electronic device according to the technology development.

Hereinafter, an electronic device according to various embodiments of the present disclosure will be described in more detail with reference to the accompanying drawings. The term "user" in this disclosure may refer to a person using an electronic device or a device using an electronic device (for example, an artificial intelligent electronic device).

FIG. 1 is a view illustrating an electronic device in a network environment 100 according to various embodiments of the present disclosure.

Referring to FIG. 1, according to various embodiments of the present disclosure, electronic devices 101, 102, and 104 and a server 106 may be connected to each other through a network 162 or a short-range communication 164. The electronic device 101 may include a bus 110, a processor 120, a memory 130, an input/output interface 150, a display 160, and a communication interface 170. According to an embodiment of the present disclosure, the electronic device 101 may omit at least one of the components or may additionally include a different component.

The bus 110, for example, may include a circuit for connecting the components 120, 130, 150, 160, and 170 to each other and delivering a communication (for example, control message and/or data) between the components 120, 130, 150, 160, and 170.

The processor 120 may include at least one of a CPU, an AP, and a communication processor (CP). The processor 120, for example, may execute calculation or data processing for control and/or communication of at least one other component of the electronic device 101.

The memory 130 may include volatile and/or nonvolatile memory. The memory 130, for example, may store instructions or data relating to at least one other component of the electronic device 101. According to an embodiment of the present disclosure, the memory 130 may store software and/or program 140. The program 140 may include a kernel 141, a middleware 143, an application programming interface (API) 145, and/or an application program (or an application) 147. At least part of the kernel 141, the middleware 143, and the API 145 may be an operating system (OS).

The kernel 141, for example, may control or manage system resources (for example, the bus 110, the processor 120, the memory 130, and so on) used for performing operations or functions implemented in other programs (for example, the middleware 143, the API 145, and the application 147). Additionally, the kernel 141 may provide an interface for controlling or managing system resources by accessing an individual component of the electronic device 101 from the middleware 143, the API 145, or the application 147.

The middleware 143, for example, may serve as an intermediary role for exchanging data as the API 145 or the application 147 communicates with the kernel 141.

Additionally, the middleware 143 may process at least one job request received from the application 147 according to a priority. For example, the middleware 143 may assign to at least one application 147 a priority for using a system resource (for example, the bus 110, the processor 120, or the memory 130) of the electronic device 101. For example, the middleware 143 may perform scheduling or load balancing on the at least one job request by processing the at least one job request according to the priority assigned to the at least one job request.

The API 145, as an interface for allowing the application 147 to control a function provided from the kernel 141 or the middleware 143, may include at least one interface or function (for example, an instruction) for file control, window control, image processing, or character control.

The input/output interface 150, for example, may serve as an interface for delivering instructions or data inputted from a user or another external device to another component(s) of the electronic device 101. Additionally, the input/output interface 150 may output instructions or data received from another component(s) of the electronic device 101 to a user or another external device.

The display 160, for example, may include a liquid crystal display (LCD), a light emitting diode (LED) display, an organic LED (OLED) display, a microelectromechanical systems (MEMS) display, or an electronic paper display. The display 160, for example, may display a variety of contents (for example, text, image, video, icon, symbol, and so on) to a user. The display 160 may include a touch screen, and for example, may receive a touch, gesture, proximity, or hovering input by using an electronic pen or a user's body part.

The communication interface 170, for example, may set a communication between the electronic device 101 and an external device (for example, first external electronic device 102, second external electronic device 104, or the server 106). For example, the communication interface 170 may communicate with an external device (for example, the second external electronic device 104 or the server 106) in connection to the network 162 through wireless communication or wired communication.

The wireless communication, as a cellular communication protocol, may use at least one of long-term evolution (LTE), LTE advanced (LTE-A), code division multiple access (CDMA), wideband CDMA (WCDMA), universal mobile telecommunications system (UMTS), wireless broadband (WiBro), global system for mobile communications (GSM), and so on. Additionally, the wireless communication, for example, may include the short range communication 164. The short range communication 164, for example, may include at least one of Wi-Fi, Bluetooth (BT), near field communication (NFC), magnetic stripe transmission (MST), or GNSS.

The MST may generate pulses by using magnetic signals according to transmission data and the pulses may generate magnetic signals. The electronic device 101 may transmit the magnetic signals to a POS and the POS may detect the magnetic signals by using an MST reader and restore the data by converting the detected magnetic signals into electrical signals.

The GNSS may include at least one of global positioning system (GPS), global orbiting navigation satellite system (GLONASS), Beidou navigation satellite system (hereinafter referred to as Beidou), and Galileo, that is, the European global satellite-based navigation system. Hereinafter, GPS and GNSS may be interchangeably used. The wired communication, for example, may include at least one of universal serial bus (USB), high definition multimedia interface (HDMI), recommended standard-232 (RS-232), and plain old telephone service (POTS). The network 162 may include a telecommunications network, for example, at least one of computer network (for example, local area network (LAN) or wireless area network (WAN)), Internet, and telephone network.

Each of the first and second external electronic devices 102 and 104 may be the same or different from the electronic device 101. According to an embodiment of the present disclosure, the server 106 may include a group of one or more servers. According to various embodiments of the present disclosure, all or part of operations executed on the electronic device 101 may be executed on another one or more electronic devices (for example, the first or second external electronic device 102 or 104 or the server 106).

According to an embodiment of the present disclosure, when the electronic device 101 performs a certain function or service automatically or by a request, it may request at least part of a function relating thereto from another device (for example, the first or second external electronic device 102 or 104 or the server 106) instead of or in addition to executing the function or service by itself. The other electronic device (for example, the first or second external electronic device 102 or 104 or the server 106) may execute a requested function or an additional function and may deliver an execution result to the electronic device 101. The electronic device 101 may provide the requested function or service as it is or by processing the received result additionally. For this, for example, cloud computing, distributed computing, or client-server computing technology may be used.

Figure 2:
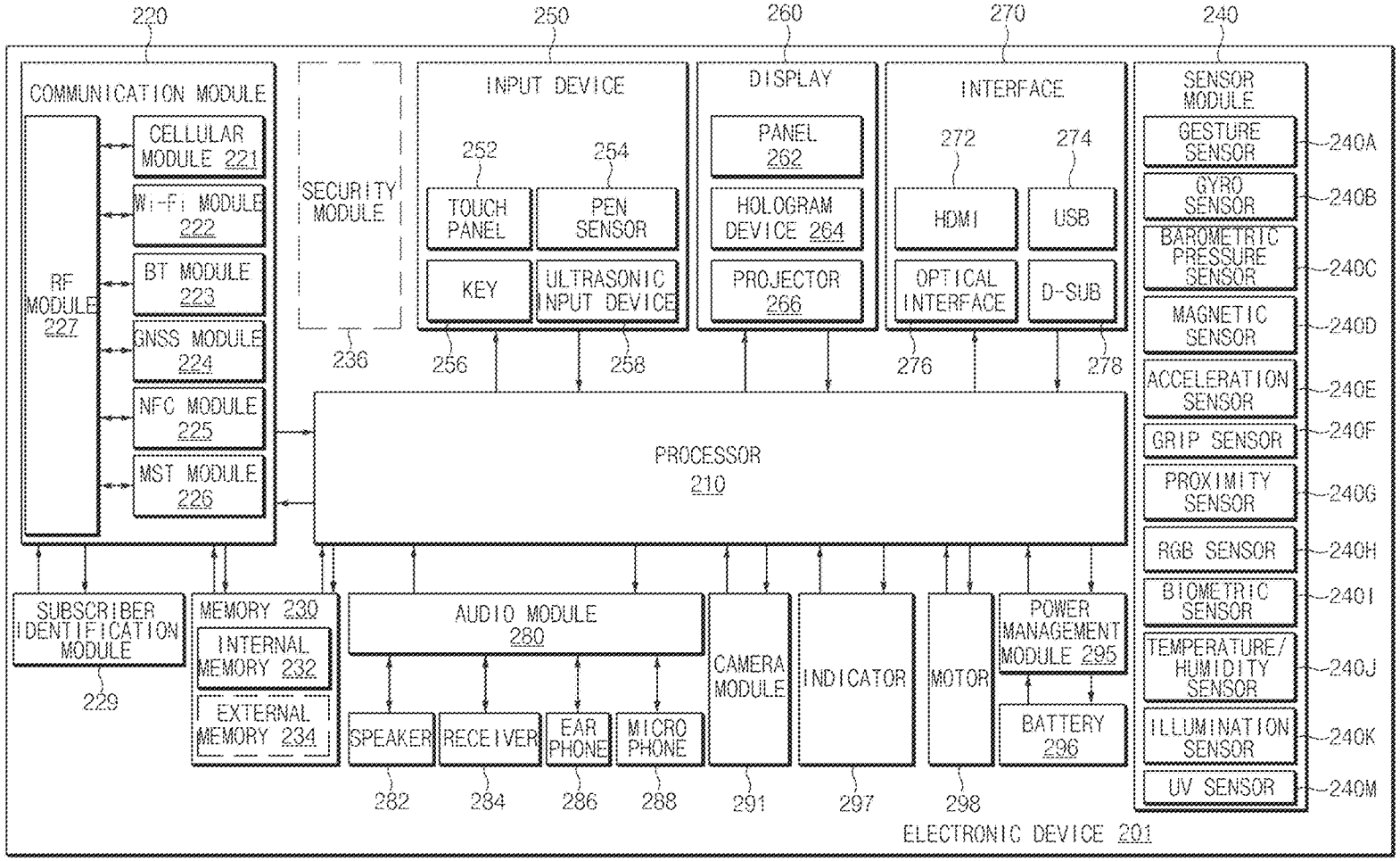
FIG. 2 is a block diagram illustrating an electronic device according to various embodiments of the present disclosure.

FIG. 2 is a block diagram illustrating an electronic device according to various embodiments of the present disclosure.

Referring to FIG. 2, an electronic device 201, for example, may include all or part of the above-mentioned electronic device 101 shown in FIG. 1. The electronic device 201 may include at least one processor (for example, processor 210), a communication module 220, a subscriber identification module (SIM) 229, a memory 230, a sensor module 240, an input device 250, a display 260, an interface 270, an audio module 280, a camera module 291, a power management module 295, a battery 296, an indicator 297, and a motor 298.

The processor 210 may control a plurality of hardware or software components connected thereto and also may perform various data processing and operations by executing an OS or an application program. The processor 210 may be implemented with a system on chip (SoC), for example. According to an embodiment of the present disclosure, the processor 210 may further include a graphics processing unit (GPU) (not shown) and/or an image signal processor (ISP). The processor 210 may include at least part (for example, cellular module 221) of components shown in FIG. 2. The processor 210 may load commands or data received from at least one of other components (for example, nonvolatile memory) and process them and may store various data in a nonvolatile memory.

The communication module 220 may have the same or similar configuration to the communication interface 170 of FIG. 1. The communication module 220 may include a cellular module 221, a Wi-Fi module 222, a BT module 223, a GNSS module 224 (for example, a GPS module, a GLONASS module, a Beidou module, or a Galileo module), an NFC module 225, an MST module 226, and a radio frequency (RF) module 227.

The cellular module 221, for example, may provide voice call, video call, text service, or Internet service through a communication network. According to an embodiment of the present disclosure, the cellular module 221 may perform a distinction and authentication operation on the electronic device 201 in a communication network by using a SIM (for example, the SIM 229). According to an embodiment of the present disclosure, the cellular module 221 may perform at least part of a function that the processor 210 provides. According to an embodiment of the present disclosure, the cellular module 221 may further include a CP.

Each of the Wi-Fi module 222, the BT module 223, the GNSS module 224, the NFC module 225, and the MST module 226 may include a processor for processing data transmitted/received through a corresponding module. According to an embodiment of the present disclosure, at least part (for example, two or more) of the cellular module 221, the Wi-Fi module 222, the BT module 223, the GNSS module 224, the NFC module 225, and the MST module 226 may be included in one integrated chip (IC) or IC package.

The RF module 227, for example, may transmit/receive communication signals (for example, RF signals). The RF module 227, for example, may include a transceiver, a power amp module (PAM), a frequency filter, a low noise amplifier (LNA), or an antenna. According to another embodiment of the present disclosure, at least one of the cellular module 221, the Wi-Fi module 222, the BT module 223, the GNSS module 224, the NFC module 225, and the MST module 226 may transmit/receive RF signals through a separate RF module.

The SIM 229, for example, may include a card including a SIM and/or an embedded SIM and also may include unique identification information (for example, an integrated circuit card identifier (ICCID)) or subscriber information (for example, an international mobile subscriber identity (IMSI)).

The memory 230 (for example, the memory 130) may include an internal memory 232 and/or an external memory 234. The internal memory 232 may include at least one of a volatile memory (for example, dynamic random access memory (DRAM), static RAM (SRAM), synchronous dynamic RAM (SDRAM)) and a non-volatile memory (for example, one time programmable read only memory (OTPROM), programmable ROM (PROM), erasable and programmable ROM (EPROM), electrically erasable and programmable ROM (EEPROM), mask ROM, flash ROM, flash memory (for example, NAND flash memory or NOR flash memory), hard drive, or solid state drive (SSD)).

The external memory 234 may further include a flash drive, for example, compact flash (CF), secure digital (SD), micro-SD, mini-SD, extreme digital (xD), multimedia card (MMC), or a memory stick. The external memory 234 may be functionally and/or physically connected to the electronic device 201 through various interfaces.

A security module 236, as a module including a storage space having a relatively higher security level than the memory 230, may be a circuit for securing safe data storage and protected execution environment. The security module 236 may be implemented as a separate circuit and may include an additional processor. The security module 236, for example, may be in a detachable smart chip or a SD card or may include an embedded secure element (eSE) embedded in a fixed chip of the electronic device 201. Additionally, the security module 236 may run on a different OS from the electronic device 201. For example, the security module 236 may run based on java card open platform (JCOP) OS.

The sensor module 240 measures physical quantities or detects an operating state of the electronic device 201, thereby converting the measured or detected information into electrical signals. The sensor module 240 may include at least one of a gesture sensor 240A, a gyro sensor 240B, a barometric pressure sensor 240C, a magnetic sensor 240D, an acceleration sensor 240E, a grip sensor 240F, a proximity sensor 240G, a color sensor 240H (for example, a red, green, blue (RGB) sensor), a biometric sensor 240L a temperature/humidity sensor 240J, an illumination sensor 240K, and an ultra violet (UV) sensor 240M. Additionally or alternatively, the sensor module 240 may include an E-nose sensor, an electromyography (EMG) sensor, an electroencephalogram (EEG) sensor, an electrocardiogram (ECG) sensor, an infrared (IR) sensor, an iris sensor, or a fingerprint sensor. The sensor module 240 may further include a control circuit for controlling at least one sensor therein. According to an embodiment of the present disclosure, the electronic device 201 may further include a processor configured to control the sensor module 240 as part of or separately from the processor 210 and thus may control the sensor module 240 while the processor 210 is in a sleep state.

The input device 250 may include a touch panel 252, a (digital) pen sensor 254, a key 256, or an ultrasonic input device 258. The touch panel 252 may use at least one of capacitive, resistive, infrared, or ultrasonic methods, for example. Additionally, the touch panel 252 may further include a control circuit. The touch panel 252 may further include a tactile layer to provide tactile response to a user.

The (digital) pen sensor 254, for example, may include a sheet for recognition as part of a touch panel or a separate sheet for recognition. The key 256 may include a physical button, an optical key, or a keypad, for example. The ultrasonic input device 258 may detect ultrasonic waves generated from an input tool through a microphone (for example, microphone 288) in order to check data corresponding to the detected ultrasonic waves.

The display 260 (for example, the display 160) may include a panel 262, a hologram device 264, or a projector 266. The panel 262 may have the same or similar configuration to the display 160 of FIG. 1. The panel 262 may be implemented to be flexible, transparent, or wearable, for example. The panel 262 and the touch panel 252 may be configured with one module. The hologram device 264 may show three-dimensional images in the air by using the interference of light. The projector 266 may display an image by projecting light on a screen. The screen, for example, may be placed inside or outside the electronic device 201. According to an embodiment of the present disclosure, the display 260 may further include a control circuit for controlling the panel 262, the hologram device 264, or the projector 266.

The interface 270 may include an HDMI 272, a USB 274, an optical interface 276, or a D-subminiature (D-sub) 278, for example. The interface 270, for example, may be included in the communication interface 170 shown in FIG. 1. Additionally or alternatively, the interface 270 may include a mobile high-definition link (MHL) interface, an SD card/MMC interface, or an infrared data association (IrDA) standard interface.

The audio module 280 may convert sound into electrical signals and convert electrical signals into sounds. At least some components of the audio module 280, for example, may be included in the input/output interface 150 shown in FIG. 1. The audio module 280 may process sound information inputted/outputted through at least one of a speaker 282, a receiver 284, an earphone 286, and a microphone 288.

The camera module 291, as a device for capturing a still image and a video, may include at least one image sensor (for example, a front sensor and/or a rear sensor), a lens (not shown), an ISP (not shown), and a flash (not shown) (for example, an LED or a xenon lamp).

The power management module 295 may manage the power of the electronic device 201. According to an embodiment of the present disclosure, the power management module 295 may include at least one of a power management IC (PMIC), a charger IC, and a battery and/or fuel gauge, for example. The PMIC may have a wired and/or wireless charging method. As the wireless charging method, for example, there is a magnetic resonance method, a magnetic induction method, or an electromagnetic method. An additional circuit for wireless charging, for example, a circuit such as a coil loop, a resonant circuit, or a rectifier circuit, may be added. The battery gauge may measure the remaining amount of the battery 296, or a voltage, current, or temperature thereof during charging. The battery 296, for example, may include a rechargeable battery and/or a solar battery.

The indicator 297 may display a specific state of the electronic device 201 or part thereof (for example, the processor 210), for example, a booting state, a message state, or a charging state. The motor 298 may convert electrical signals into mechanical vibration and may generate vibration or haptic effect. Although not shown in the drawings, the electronic device 201 may include a processing device (for example, a GPU) for mobile TV support. A processing device for mobile TV support may process media data according to the standards such as digital multimedia broadcasting (DMB), digital video broadcasting (DVB), or mediaFLO™.

Each of the above-mentioned components of the electronic device according to various embodiments of the present disclosure may be configured with at least one component and the name of a corresponding component may vary according to the kind of an electronic device. According to various embodiments of the present disclosure, an electronic device may include at least one of the above-mentioned components, may not include some of the above-mentioned components, or may further include another component. Additionally, some of the components in an electronic device according to various embodiments of the present disclosure may be configured as one entity, so that functions of previous corresponding components are performed identically.

Figure 3A:
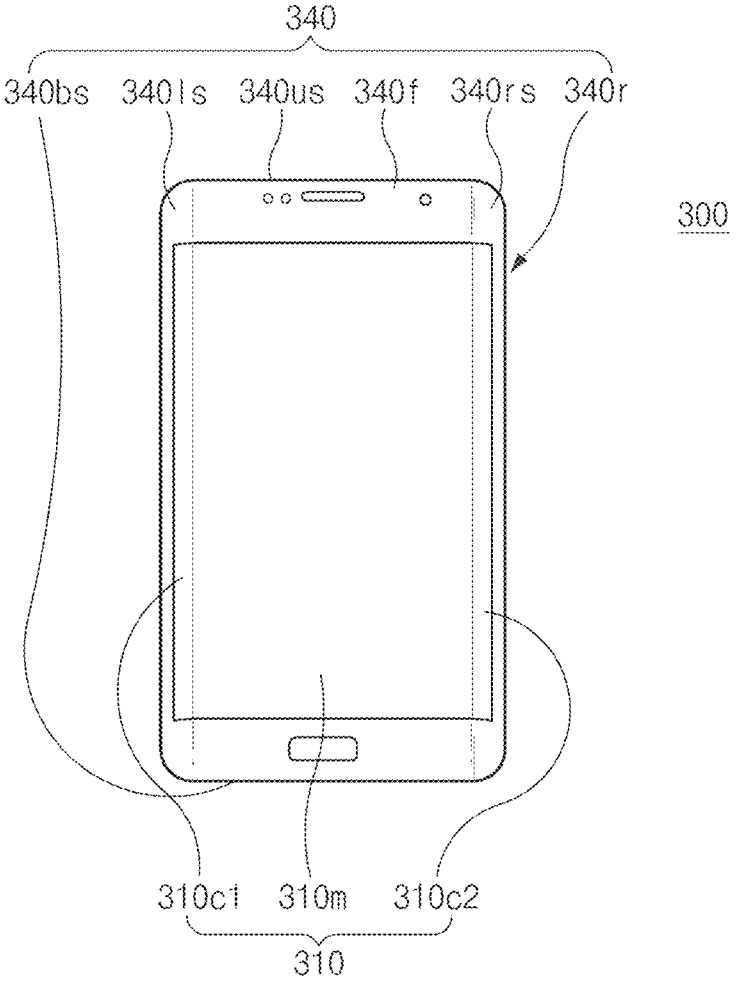
FIGS. 3A to 3C are views illustrating an electronic device where an antenna structure is mountable according to various embodiments of the present disclosure.
Figure 3B:
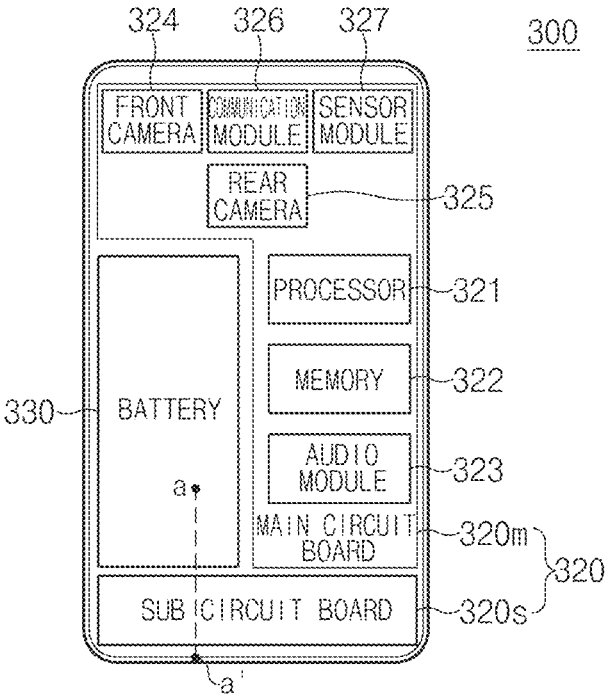
Figure 3C:
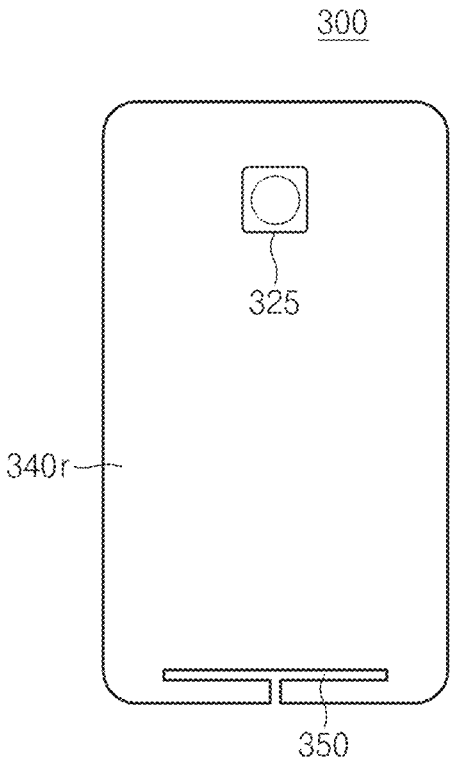

FIGS. 3A to 3C are views illustrating an electronic device where an antenna structure is mountable according to various embodiments of the present disclosure.

FIG. 3A illustrates the front appearance of an electronic device 300, FIG. 3B illustrates the inner configuration of the electronic device 300, and FIG. 3C illustrates the rear appearance of the electronic device 300. The electronic device 300 shown in FIGS. 3A to 3C, for example, may correspond to the electronic device 101 of FIG. 1 or the electronic device 201 of FIG. 2. According to various embodiments of the present disclosure, the electronic device 300 may omit at least one of the components shown in FIGS. 3A to 3C or may additionally include a different component.

Referring to FIG. 3A, the front appearance of the electronic device 300 may include a display 310 and a housing 340.

The display 310 (for example, the display 160 of FIG. 1) according to various embodiments of the present disclosure may display various contents (for example, text, image, video, icon, symbol, and so on). The display 310 may include a touch screen, and for example, may receive a touch, gesture, proximity, or hovering input by using an electronic pen or a user's body part.

According to an embodiment of the present disclosure, the display 310 may correspond to a curved display where some display areas are curved. For example, the display 310 may include a main display area 310*m* and curved display areas 310*c*1 and 310*c*2 that are continuously connected to the main display area 310*m*. The main display area 310*m* and the curved display areas 310*c*1 and 310*c*2 may be implemented with one display 310.

The housing 340 according to various embodiments of the present disclosure may be formed of plastic injections and/or metal materials in order to protect various components in an electronic device from external impact or dust. According to various embodiments of the present disclosure, at least a portion of the housing 340 may be formed of a metallic material. For example, if a side housing of the housing 340 is formed of metal, a so-called metallic bezel may be implemented. According to various embodiments of the present disclosure, at least a portion of the part implemented with metal in the housing 340 may be utilized as an antenna radiator.

According to an embodiment of the present disclosure, the housing 340 (or an external housing) may include a front housing 340*f*, a rear housing 340*r*, an upper-side housing 340*us*, a bottom-side housing 340*bs*, a left-side housing 340*ls*, and a right-side housing 340*rs*. In this specification, the rear housing 340*r* may be referred to as a first surface and the front housing 340*f* facing the rear housing 340*r* may be referred to as a second surface. At least one of the upper/bottom/left/right-side housings connecting the rear housing 340*r* (or the first surface) and the front housing 340*f* (or the second surface) may be referred to as a third surface.

According to various embodiment of the present disclosure, according to an arrangement position, additional reference numerals are used for the front housing 340*f*, the rear housing 340*r*, the upper-side housing 340*us*, the bottom-side housing 340*bs*, the left-side housing 340*ls*, and the right-side housing 340*rs*. However, the references numerals do not mean that each constitutes a separate independent configuration or component. For example, at least one of the front housing 340*f*, the rear housing 340*r*, the upper-side housing 340*us*, the bottom-side housing 340*bs*, the left-side housing 340*ls*, and the right-side housing 340*rs* may be implemented with one configuration (or material).

For example, when the upper-side housing 340*us*, the bottom-side housing 340*bs*, the left-side housing 340*ls*, and the right-side housing 340*rs* are implemented with one configuration, they may form a continuous border (or bezel) of the electronic device 300. According to another example, the rear housing 340*r* may be separated from another part of the housing 340. According to another example, the left/right-side housings 340*ls* and 340*rs* and the front housing 340*f* may be formed continuously as one configuration. According to another example, at least one of the upper/bottom/left/right-side housings and the rear housing 340*r* may be formed continuously as one configuration. At this point, a conductive member configuring at least a portion of the rear housing 340*r* may expand to at least a portion of the upper/bottom/left/right-side housings (or a third surface). In addition to the examples, each part of the housing 340 may be implemented with one configuration (or one material) through various combinations.

According to various embodiments of the present disclosure, in addition to the main display area 310*m*, the front housing 340*f* may form the front appearance of the electronic device 300. A user-manipulating physical button (for example, a home button), various sensors (for example, a proximity sensor), a speaker for voice call, and a front camera may be disposed at the front housing 340*f*, for example.

According to various embodiments of the present disclosure, the left/right-side housings 340*ls* and 340*rs* housings, together with the respective curved display areas 310*c*1 and 310*c*2, may form the left/right-side appearances of the electronic device 300.

According to various embodiments of the present disclosure, the upper/bottom-side housings 340*us* and 340*bs* may form the upper/bottom-side appearances of the electronic device 300. For example, the upper/bottom-side housings 340*us* and 340*bs* may include an interface terminal (for example, a USB terminal and an audio terminal) for wired connection with an external electronic device and a user-manipulating physical button (for example, a power button). The rear housing 340*r* is described later with reference to FIG. 3C.

Referring to FIG. 3B, an internal configuration of the electronic device 300 according to an embodiment of the present disclosure is shown. The electronic device 300 may include various modules shown in FIG. 3B, and in addition, further include at least part of various configurations shown in the electronic device 101 of FIG. 1 or the electronic device 201 of FIG. 2.

According to various embodiments of the present disclosure, a circuit board 320 may include a main circuit board 320*m* and/or a sub circuit board 320*s*. The circuit board 320, for example, may be implemented with a printed circuit board (PCB) or a flexible (FPCB). In some embodiments, the circuit board 320 may be referred to as a main board.

According to various embodiments of the present disclosure, the circuit board 320 may include various circuit configurations and/or modules of the electronic device 300. For example, a processor 321 (corresponding to the processor 120 of FIG. 1), a memory 322 (corresponding to the memory 130 of FIG. 1), an audio module 323, a front camera 324, a rear camera 325, a communication module 326 (corresponding to the communication interface 170 of FIG. 1), and/or a sensor module 327 may be mounted on or electrically connected to the circuit board 320.

According to various embodiments of the present disclosure, a battery 330 may convert chemical energy and electrical energy in both directions. For example, the battery 330 may convert chemical energy to electrical energy to supply it to various modules mounted on the circuit board 320 or convert electrical energy supplied from the outside to chemical energy and store it. For this, the circuit board 320 may include a power management module for managing a charging/discharging of the battery 330.

Referring to FIG. 3C, the rear appearance of the electronic device 300 is shown according to an embodiment of the present disclosure. The rear appearance of the electronic device 300, for example, may include the rear housing 340*r* and the rear camera 325. Although not shown in the drawing, for example, various sensors (for example, a heart rate sensor, an infrared sensor, and so on) may be disposed in the rear housing 340*r*.

According to various embodiments of the present disclosure, the rear housing 340*r*, for example, may be combined with the upper/bottom/left/right-side housings 340*us*, 340*bs*, 340*ls*, and 340*rs* shown in FIG. 3A in order to close a space where the circuit board 320 and the battery 330 are mounted. For example, the rear housing 340*r* may be configured as one configuration with the upper/bottom/left/right-side housings 340*us*, 340*bs*, 340*ls*, and 340*rs* or may be implemented to be detachable from them. As in the above, an opening 350 and an opening for the rear camera 325 may be formed at the rear housing 340*r* according to various embodiments of the present disclosure.

According to various embodiments of the present disclosure, at least a portion of the housing 340 may be formed of a metallic material. For example, at least a portion of the rear housing 340*r* (for example, the first surface) may be formed of a conductive member. According to various embodiments of the present disclosure, the opening 350 may be formed as penetrating at least a portion of the housing 340 formed of the metallic material (or the conductive member). According to various embodiments of the present disclosure, the opening 350 may be referred to as a slot. If one side (or one surface) is open to the outside space or contacts another nonconductor, it may be referred to as an open slot. According to an embodiment of the present disclosure, the opening 350, for example, may include a portion extending in a first direction and a portion extending in a second direction. The first direction may be substantially perpendicular to the second direction. Through this, for example, the opening 350 may be formed in a 'T' shape.

The electronic device 300 described above may include an antenna structure for performing wireless communication and may communicate with the outside as including the antenna structure. The antenna structure is described below with reference to FIGS. 4, 5, 6A and 6B, 7A and 7B, and 8 to 15 in relation to the housing 340 of the electronic device 300.

Figure 4:
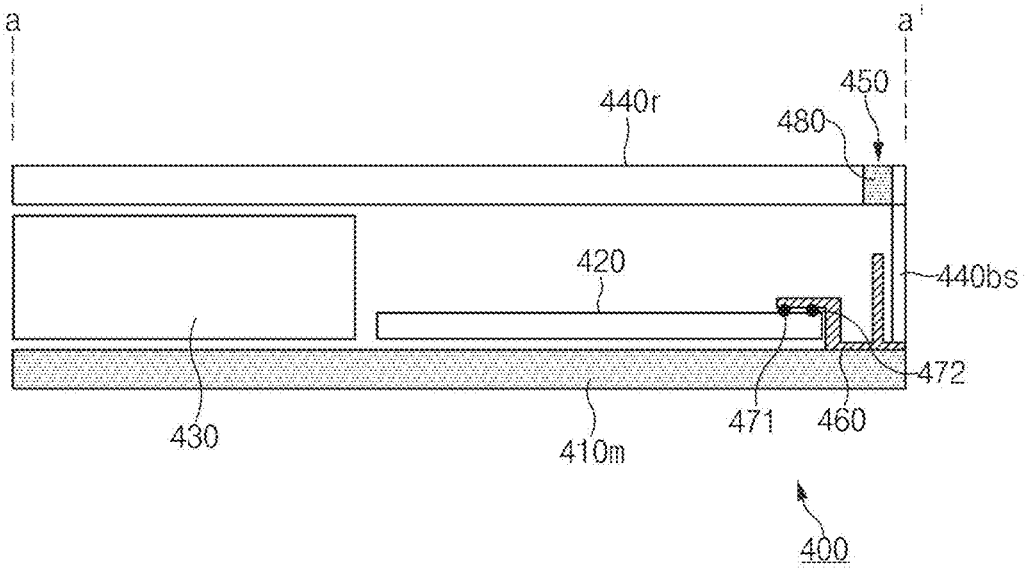
FIG. 4 is a sectional view of an electronic device where an antenna structure is mounted according to an embodiment of the present disclosure.

FIG. 4 is a sectional view of an electronic device where an antenna structure is mounted according to an embodiment of the present disclosure.

Referring to FIG. 4, a sectional view of an electronic device 400 according to an embodiment of the present disclosure, for example, may correspond to a sectional view taken along a line a-a' of the electronic device 300 shown in FIG. 3B. Description for a configuration shown in FIG. 4, which corresponds to the configurations shown in FIGS. 3A to 3C, may be omitted.

A main display area 410*m*, a circuit board 420, a battery 430, a bottom-side housing 440*bs*, a rear housing 440*r*, and an antenna radiator 460 are shown in the sectional view of the electronic device 400 shown in FIG. 4. Although not shown in FIG. 4, in addition to the configurations, a bracket for physically supporting various configurations embedded in the electronic device 400 may be further included therein.

According to various embodiments of the present disclosure, it may be indicated that "antenna structure" may include the antenna radiator 460 for transmitting/receiving radio waves in a specified frequency band, the circuit board 420 including a feeding unit and/or a ground unit, and at least a portion (for example, a conductive member of the rear housing 440*r*) of the rear housing 440*r*.

According to various embodiments of the present disclosure, the antenna radiator 460 is disposed in the housing to be electrically connected to the circuit board 420. For example, the antenna radiator 460 may form an electrical path with the circuit board 420 through a feeding unit 471 and a ground unit 472. The feeding unit 471 and/or the ground unit 472, for example, may be configured including a pin or a C-clip. The antenna radiator 460, for example, may be electrically connected to a communication module mounted on the circuit board 420 through the electrical path. For example, the communication module may feed power to the antenna radiator 460 in order to transmit/receive signals in a specified frequency.

According to various embodiments of the present disclosure, the antenna radiator 460 may have various numbers and forms (for example, lengths, thicknesses, and patterns) according to specified radio waves. For example, the antenna radiator 460 may be implemented in an inverted F shape from the arrangement of the feeding unit 471 and the ground unit 472. An antenna including the antenna radiator 460 in such a shape may be referred to as a planar inverted F antenna (PIFA).

According to various embodiments of the present disclosure, the antenna radiator 460 may be provided in plurality in the electronic device 300 in order to improve directivity. The antenna radiator 460, for example, may be formed through a FPC process, a laser direct structuring (LDS) process, an in-mold antenna (IMA) process, or a direct printed antenna (DPA) process. A method of forming the antenna radiator 460 is not limited to the above. According to another example, the antenna radiator 460 may be formed by insert injection or double injection in such a way that the antenna radiator 460 is exposed or not exposed to the electronic device 400.

In relation to an antenna structure according to various embodiments of the present disclosure, the circumference portion of an opening 450 formed at the rear housing 440*r* may be coupled to the antenna radiator 460 and used as a portion thereof. According to an embodiment of the present disclosure, the electronic device 400 may radiate radio waves through the antenna radiator 460 primarily. The radiated radio waves may be delivered to a reception device through the opening 450.

According to an embodiment of the present disclosure, at least a portion of the rear housing 440*r* may be formed of a conductive member. For example, the opening 450 may be formed in at least a portion of the rear housing 440*r* that is formed of the conductive member. According to an embodiment of the present disclosure, at least a portion of the opening 450 may be filled with a dielectric member 480 having a very low conductivity (for example, a non-conductive material).

According to various embodiments of the present disclosure, as spaced a predetermined distance apart from the antenna radiator 460, the circumference portion of the opening 450 (for example, a portion of a conductive member) may be electromagnetically coupled to the antenna radiator 460. Through this, charges may be induced at the circumference portion of the opening 450 formed at the rear housing 440*r*, and the electronic device 400 may radiate radio waves through the circumference portion of the opening 450. For another example, by the coupling between the opening 450 and the antenna radiator 460, an operating frequency band of radio waves radiated from the antenna radiator 460 may be changed or an additional operating frequency may be generated. That is, the opening 450 may be understood as an extended antenna radiator of the antenna radiator 460.

Figure 5:
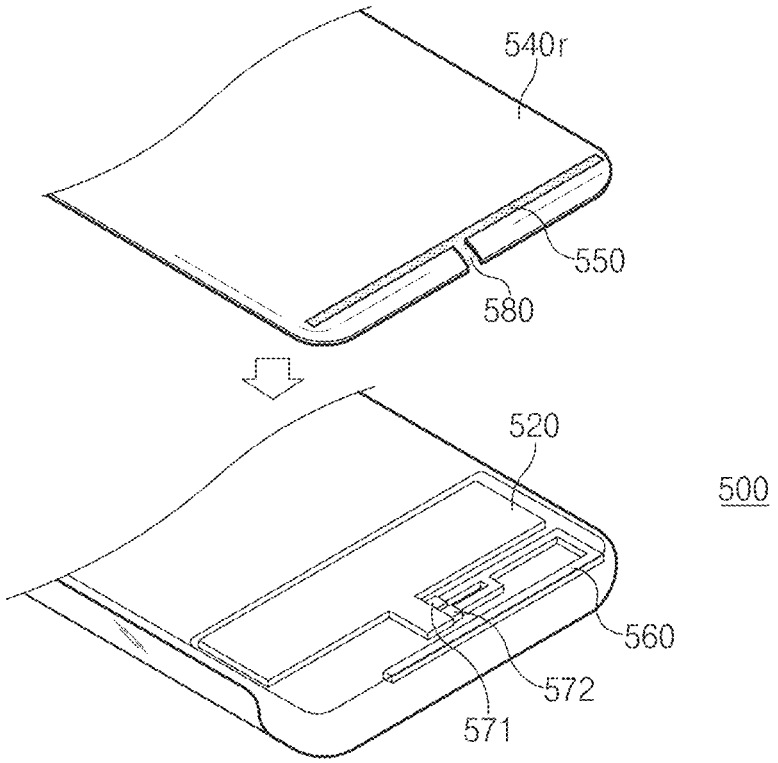
FIG. 5 is a view illustrating an electronic device where an antenna structure is mounted according to an embodiment of the present disclosure.

FIG. 5 is a view illustrating an electronic device where an antenna structure is mounted according to an embodiment of the present disclosure.

Referring to FIG. 5, an electronic device 500 is shown according to an embodiment of the present disclosure. Description for a configuration of the electronic device 500 shown in FIG. 5, which corresponds to the configurations shown in FIGS. 3A to 3C and 4, may be omitted.

According to an embodiment of the present disclosure, one side of the housing of the electronic device 500, for example, at least a portion of rear housing 540*r*, may be formed of a conductive member (for example, a metallic member). An opening 550 may be formed at a portion formed of a conductive material in the rear housing 540*r*. The opening 550 may be filled with a dielectric member 580 that is a nonconductor in order to prevent the inflow of dust or liquid.

According to an embodiment of the present disclosure, in relation to the rear housing 540*r*, a peripheral part surrounding the opening 550 may be formed of a conductive member. According to another embodiment of the present disclosure, the entire rear housing 540*r* may be substantially formed of a conductive member. According to some embodiments of the present disclosure, at least a portion of the rear housing 540*r* may be formed of a member of a synthetic resin coated with a metal.

According to an embodiment of the present disclosure, the opening 550 may include a portion (or a first portion) extending in a first direction (for example, a horizontal direction of the electronic device 500) of the electronic device 500 and a portion (or a second portion) extending in a second direction (for example, a vertical direction of the electronic device 500). For example, the portion extending in the second direction may be formed branching from the portion extending in the first direction, and the first direction and the second direction may be substantially perpendicular to each other. Through this, for example, the opening 550 may be formed in a 'T' shape.

For example, the portion extending in the first direction may be formed not extending to the left/right-side housings of the electronic device 500. Additionally, for example, the portion extending in the second direction is formed to extend toward the upper-side housing or the bottom-side housing of an electronic device but one side of the portion extending in the second direction may be open to the outside space or contact a nonconductor.

According to an embodiment of the present disclosure, the rear housing 540*r* may be coupled to at least a portion of the upper/bottom/left/right of the housing of the electronic device 500. The electronic device 500, for example, may include a circuit board 520 and an antenna radiator 560 electrically connected to the circuit board 520 through a feeding unit 571 and/or a ground unit 572.

According to an embodiment of the present disclosure, when the rear housing 540*r* is coupled to the upper/bottom/left/right housings of the electronic device 500, the opening 550 of the rear housing 540*r* may be spaced a specified distance apart from a position corresponding to the antenna radiator 560. For example, the specified distance may be set to less than several mm to allow the circumference of the opening 550 to be electromagnetically coupled to the antenna radiator 560. Based on the coupling, an operating frequency band of radio waves radiated from the antenna radiator 560 may be changed or an additional operating frequency may be generated.

Figure 6A:
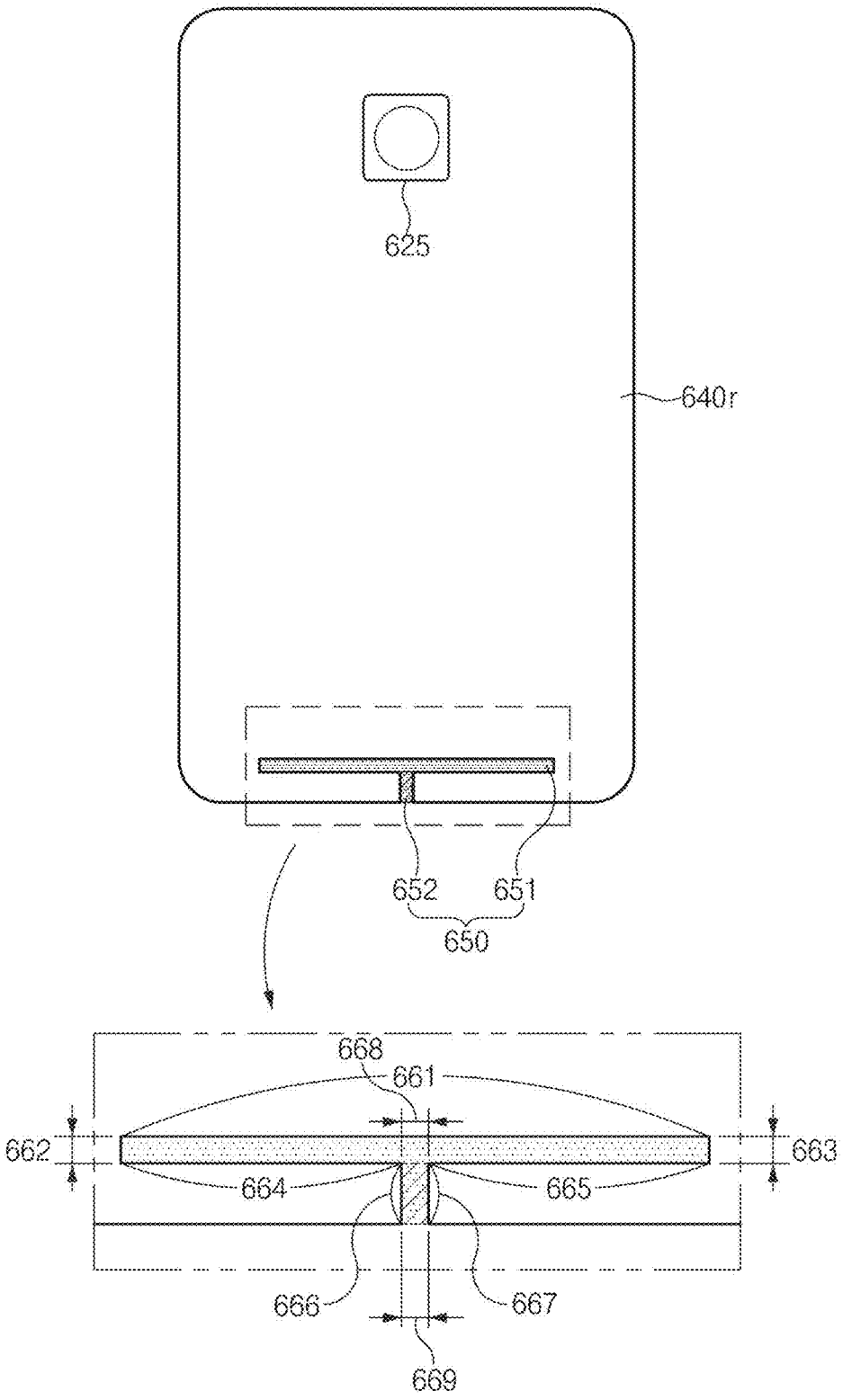
FIGS. 6A and 6B are views illustrating an opening according to various embodiments of the present disclosure.

FIG. 6A is a view illustrating a rear housing where an opening is formed according to an embodiment of the present disclosure.

A rear housing 640*r* where an opening 650 is formed according to an embodiment of the present disclosure is shown in FIG. 6A. Description for a configuration shown in FIG. 6A, which corresponds to the configurations shown in FIGS. 3A to 3C, 4, and 5, may be omitted.

According to an embodiment of the present disclosure, the opening 650 may be spaced a predetermined distance, apart from a lower end of the rear housing 640*r*, for example, a rear camera 625. The opening 650 may be formed as penetrating the rear housing 640*r* in a thickness direction.

According to an embodiment of the present disclosure, the opening 650 may include a first portion 651 and a second portion 652. The first portion 651 and/or the second portion 652 may be formed in an oblong shape. For example, the oblong shape may include a form in which a width direction length is shorter than a longitudinal direction length (that is, a straight line form).

According to an embodiment of the present disclosure, the first portion 651 may be formed of an oblong shape surrounded by a first boundary 661, a second boundary 662, a third boundary 663, a fourth boundary 664, a fifth boundary 665, and a joint open boundary 668 with respect to the second portion 652. The first portion 651 may be formed to align with the length direction of an antenna radiator at a position corresponding to the antenna radiator embedded in an electronic device. Alternatively, for example, the first portion 651 may extend to align (or substantially parallel to) with at least a portion of the antenna radiator.

According to an embodiment of the present disclosure, the second portion 652 may be formed extending vertically from a portion of the first portion 651. The second portion 652 may extend toward one periphery of the rear housing 640*r* having the opening 650 formed, from a portion of the first portion 651. According to an embodiment of the present disclosure, when a portion of the rear housing 640*r* is formed of a conductive member, the one periphery may correspond to a boundary side of a portion formed of a conductive member and a portion formed of a non-conductive member other than that in the rear housing 640*r*.

Alternatively, for example, the second portion 652 may be formed in an oblong shape surrounded by the joint open boundary 668 with respect to the first portion 651, a sixth boundary 666, a open boundary 669 with respect to the outside space, and a seventh boundary 667. The second portion 652 may be connected (or communicated) to the first portion 651 through the joint open boundary 668 with respect to the first portion 651 but may be formed in a direction that forms a specified angle (for example, 90 degrees) with respect to the length direction of an antenna radiator.

According to various embodiments of the present disclosure, the length direction of an antenna radiator may mean a direction in which a relatively long portion of the antenna radiator extends in appearance as the antenna radiator disposed inside an electronic device is formed with various patterns. For example, when an antenna radiator is substantially formed in an "F" form, the length direction may correspond to an extension direction of a relatively long line that branches two relatively short lines in "F."

For another example, referring to FIG. 5, the length direction of the antenna radiator may correspond to a direction in which a relatively long portion extends in terms of the form of a corresponding antenna radiator. This, for example, may correspond to the width direction of the electronic device 500 when the electronic device 500 operates in portrait mode.

Referring to FIG. 6A, the length direction of an antenna radiator embedded in an electronic device may correspond to the extension direction of the first portion 651, that is, the extension direction (hereinafter referred to as a length direction) of the first surface 661, the fourth surface 664, or the fifth surface 665, all of which surround the first portion 651.

According to various embodiments of the present disclosure, the case that the first portion 651 is formed to align with the length direction of an antenna radiator may include the case that the length direction of the first portion 651 and the length direction of the antenna radiator are substantially aligned with each other or intersect at a specified angle (for example, 10 degrees).

According to an embodiment of the present disclosure, at least a portion of the circumference of the opening 650 may include an electrical open curve. For example, since it is possible that all or a portion of the rear housing 640*r* of FIG. 6A is formed of a conductive member, an electrical open curve may be formed in a portion of the entire circumference (for example, the first boundary 661 to the seventh boundary 667 and the open boundary 669) of the opening 650.

For example, the electrical open curve may be formed in the first surface 661 to the seventh boundary 667 in the entire circumference of the opening 650. The length l (which equals the sum of lengths of the first surface 661 to the seventh boundary 667) of the electrical open curve is determined by the following Equation 1 based on a specified radio wave.

$$l = \frac{\lambda}{4} = \frac{c}{4f} \text{ or } f = \frac{c}{4l} \qquad \text{Equation 1}$$

At this point, 'l' represents the length of an electrical open curve, 'λ' represents the wavelength of a radio wave, 'c' represents the speed of light, and 'f' represents the operating frequency of a radio wave. For example, when an electronic device performs wireless mobile communication at a frequency of 2 GHz, the length l of the electrical open curve may be set to 3.75 cm=3*10^8/(4*2*10^9). If the circumference of the opening 650 forms an electrical closed curve, the (circumference) length of the electrical closed curve should be λ/2. According to various embodiments of the present disclosure, as at least a portion of the circumference of the opening 650 includes an electrical open curve, that is, one side of the opening 650 is open, the same resonance frequency may be formed only with a length of λ/4. Accordingly, in comparison to a case of forming an electrical closed curve, the size of an opening may be further minimized.

Figure 6B:
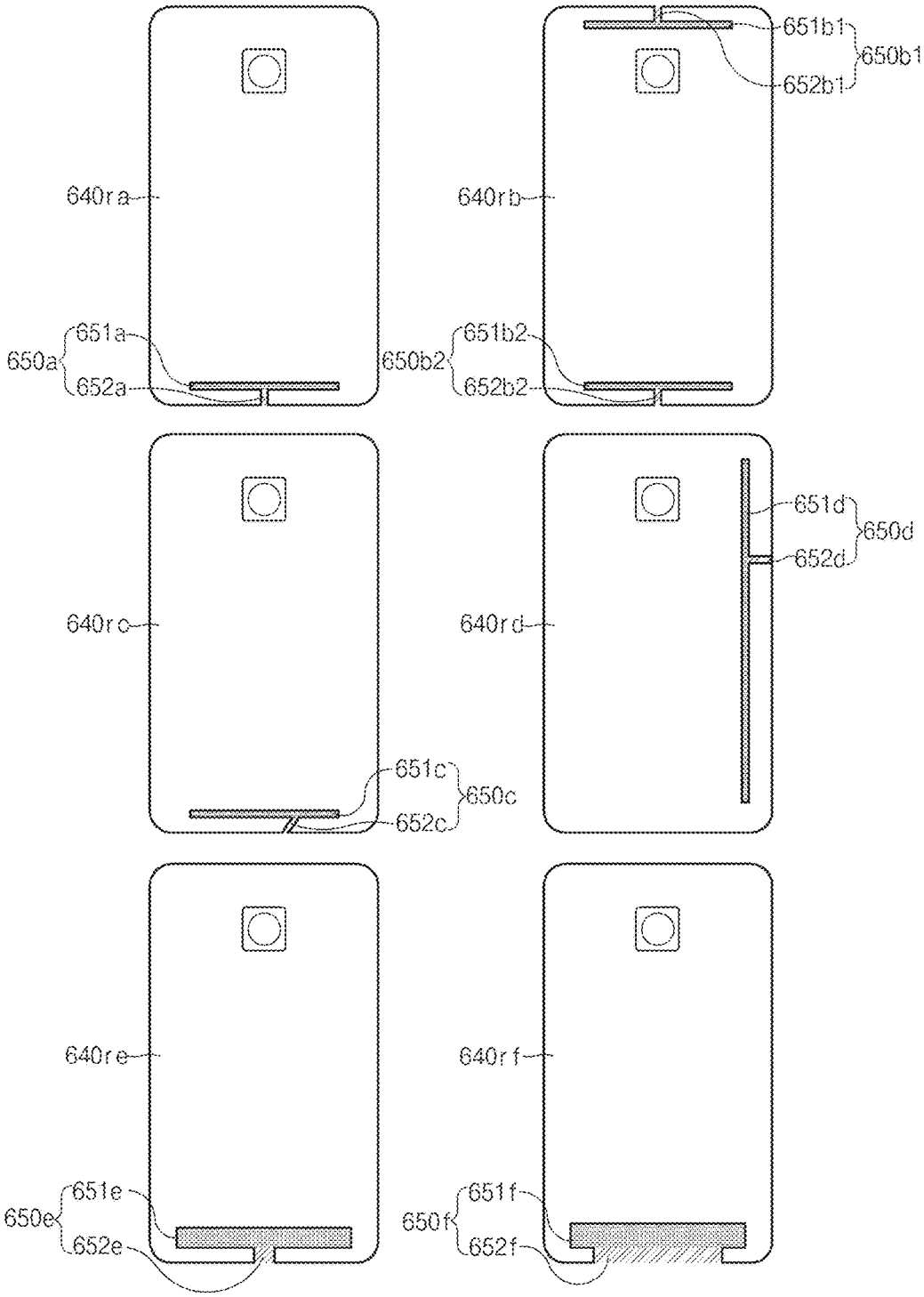

FIG. 6B is a view illustrating a rear housing where an opening is formed according to various embodiments of the present disclosure.

Referring to FIG. 6B, rear housings 640*ra*, 640*rb*, 640*rc*, 640*rd*, 640*re*, and 640*rf* according various embodiments of the present disclosure are shown. Although it is described with reference to FIG. 6B that openings 650*a*, 650*b*, 650*c*, 650*d*, 650*e*, and 650*f* are respectively formed at the rear housings 640*ra*, 640*rb*, 640*rc*, 640*rd*, 640*re*, and 640*rf* of an electronic device, the forms and positions of the openings 650*a*, 650*b*, 650*c*, 650*d*, 650*e*, and 650*f* may be limited to the example of FIG. 6B. Since the length of an electrical open curve formed at a portion of the circumferences of the openings 650*a*, 650*b*, 650*c*, 650*d*, 650*e*, and 650*f* is only required to have a length required by a resonance frequency, various applications examples are possible.

According to an embodiment of the present disclosure, the opening 650*a* may be formed at a lower end of the rear housing 640*ra*. The opening 650*a* may include a first portion 651*a* and a second portion 652*a* connected to the first portion 651*a*.

According to various embodiments of the present disclosure, the first portion 651*a* may be formed substantially aligned with the length direction of an antenna radiator or intersecting less than a predetermined angle (for example, 10 degrees), at a position corresponding to the antenna radiator embedded in an electronic device.

According to various embodiments of the present disclosure, the first portion 651*a* may be formed not to extend toward the left/right-side housings of an electronic device. For example, the first portion 651*a* may not be deviated from the rear housing 640*ra*. Since it is possible that the first portion 651*a* of the electronic device does not extend toward the left/right-side housings of the electronic device, antenna performance deterioration (that is, performance deterioration influence (for example, hand effect) during hand grip, and a drastic performance deterioration phenomenon occurring when a hand contacts a specific area of a death-grip antenna), which may occur according to a user's grip position, may be prevented.

According to various embodiments of the present disclosure, one side of the second portion 652*a* may be connected (or communicated) to the first portion 651*a*. For example, as the second portion 652*a* is formed in a direction that forms 90 degrees with respect to the first portion 651*a*, the first portion 651*a* and the second portion 651*b* may form a 'T' shape.

According to various embodiments of the present disclosure, as the opening 650*a* is formed in the rear housing 640*ra*, the antenna radiation pattern may be oriented toward the rear of the electronic device. Therefore, since an existing antenna radiation pattern oriented toward the direction of the front (that is, a side including a main display area) of an electronic device is moved to the rear, a performance deterioration phenomenon due to body influence may be prevented.

According to an embodiment of the present disclosure, a plurality of openings, which are used as an antenna radiator, may be formed at the rear housing 640*rb*. For example, an opening 650*b*1 and an opening 650*b*2 may be respectively formed at an upper end and a lower end of the rear housing 640*rb*. The upper end opening 650*b*1 and the lower end opening 650*b*2 may include first portions 651*b*1 and 651*b*2, and second portions 652*b*1 and 652*b*2 that are respectively connected to the first portions 651*b*1 and 651*b*2.

According to an embodiment of the present disclosure, the openings 650*b*1 and 650*b*2, for example, may be formed at positions corresponding to respective different antenna radiators. The circumferences of the openings 650*b*1 and 650*b*2 may be electromagnetically coupled to corresponding respective antenna radiators. According to one example, each of the antenna radiators may be functionally connected to a communication module using a different operating frequency.

For example, the opening 650*b*1 may be spaced a predetermined distance to be coupled to an antenna radiator functionally connected to a Wi-Fi module. The opening 650*b*2 may be spaced a predetermined distance to be coupled to an antenna radiator functionally connected to a cellular module (for example, a 3rd generation (3G)/4th generation (4G) communication module). According to various embodiments of the present disclosure, antenna radiators coupled to the openings 650*b*1 and 650*b*2 may be functionally connected to various types of communication modules such as a BT module, a GPS module, and so on in addition to a Wi-Fi module and a cellular module.

According to an embodiment of the present disclosure, the opening 650*c* including a first portion 651*c* and a second portion 652*c* may be formed at the rear housing 640*rc*.

According to various embodiments of the present disclosure, the first portion 651*c* may be formed to substantially align with the length direction of an antenna radiator, or intersecting less than a predetermined angle (for example, 10 degrees), at a position corresponding to the antenna radiator embedded in an electronic device.

According to various embodiments of the present disclosure, the second portion 652*c* may be connected (or communicated) to the first portion 651*c* but may be formed in a direction that forms a specified angle (for example, 60 degrees) with respect to the length direction of an antenna radiator. If the long side of the first portion 651*c* is substantially aligned with the length direction of an antenna radiator, the long side of the second portion 652*c* may form the specified angle with respect to the long side of the first portion 651*c*. That is, since the first portion 651*c* and the second portion 652*c* are disposed on the rear housing 640*r*, they may not be connected (or communicated) to each other vertically.

According to an embodiment of the present disclosure, the opening 650*d* including a first portion 651*d* and a second portion 652*d* may be formed at the rear housing 640*rd*.

In relation to an internal configuration of an electronic device according to an embodiment of the present disclosure, an antenna radiator may extend in the length direction of the electronic device (that is, the long side direction of the electronic device when the electronic device operates in portrait mode).

At this point, the first portion 651*d* may be formed to align with the length direction of the antenna radiator at a position corresponding to the antenna radiator. According to an embodiment of the present disclosure, the second portion 652*d* may be connected (or communicated) to the first portion 651*d* but may be formed in the length direction of an antenna radiator or in a direction that forms a specified angle (for example, 60 degrees, 90 degrees, and so on) with respect to the length direction of the first portion 651*d*. According to an embodiment of the present disclosure, the second portion 652*d* may be formed to extend toward one periphery (for example, one periphery coupled to the right-side housing) of the rear housing 640*d*.

According to an embodiment of the present disclosure, the opening 650*e* including a first portion 651*e* and a second portion 652*e* may be formed at the rear housing 640*re*. According to another embodiment of the present disclosure, the opening 650*f* including a first portion 651*f* and a second portion 652*f* may be formed at the rear housing 640*rf*.

According to an embodiment of the present disclosure, the first portions 651*e* and 651*f* and the second portions 652*e* and 652*f* may be formed in an oblong shape in which the length of each side is greater than a predetermined length. However, in this case, the length of a portion forming an electrical open curve in the circumferences of the opening parts 650*e* and 650*f* may be set to an operating frequency based length.

Figure 7A:
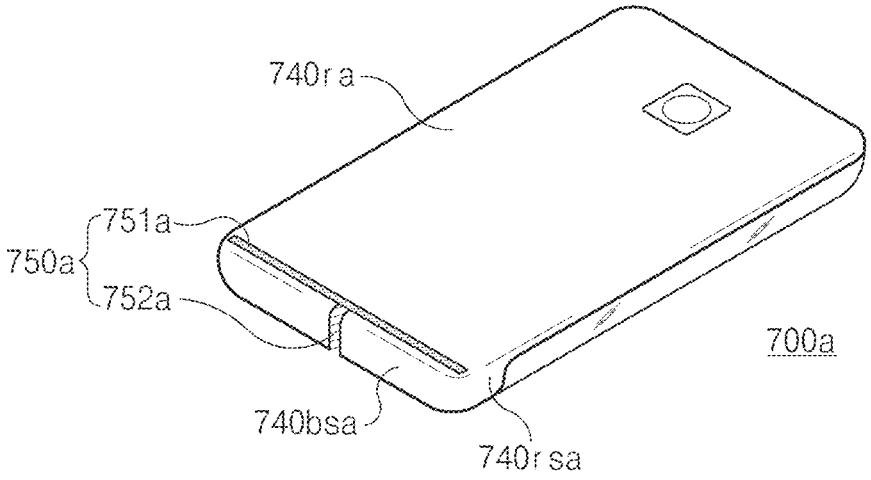
FIGS. 7A and 7B are views illustrating an electronic device where an opening is formed according to various embodiments of the present disclosure.
Figure 7B:
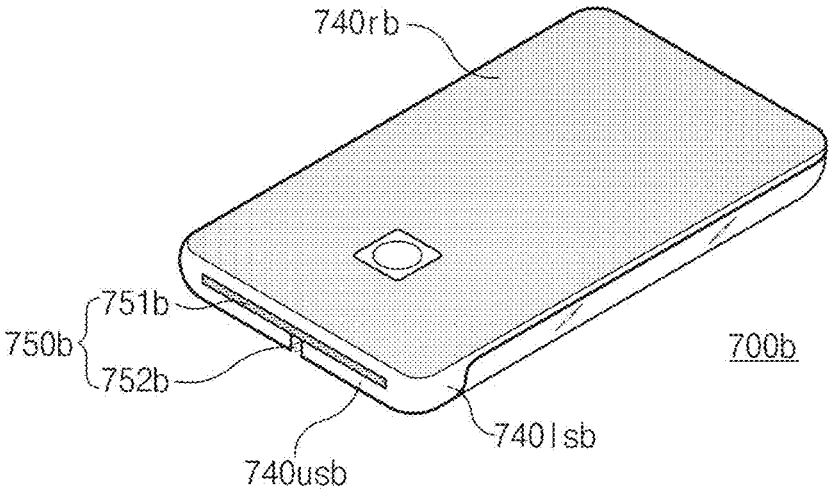

FIGS. 7A and 7B are views illustrating an electronic device where an opening is formed according to various embodiments of the present disclosure.

An opening according to an embodiment of the present disclosure may be formed in a rear housing as shown in FIGS. 6A and 6B but may be formed in a side housing or a front housing of an electronic device. According to an embodiment of the present disclosure, an opening may be formed over a housing with a plurality of sides of an electronic device.

Referring to FIG. 7A, an electronic device is shown according to an embodiment of the present disclosure. As part of a housing that surrounds an electronic device 700*a*, a rear housing 740*ra*, a right-side housing 740*rsa*, and a bottom-side housing 740*bsa* are shown in FIG. 7A. According to various embodiments of the present disclosure, including the rear housing 740*ra*, the right-side housing 740*rsa*, and the bottom-side housing 740*bsa*, a great portion of the housing of the electronic device 700*a* may be implemented with one configuration by using a conductive member.

According to an embodiment of the present disclosure, an opening 750*a* may be formed over the rear housing 740*ra* and the bottom-side housing 740*bsa*. For example, a first portion 751*a* of the opening 750*a* may be formed at a lower end part of the rear housing 740*ra*. In relation to the rear housing 740*ra*, the first portion 751*a* may be formed at a position corresponding to an antenna radiator embedded in the electronic device 700*a*. For example, the length direction of the first portion 751*a* may correspond to the length direction of the antenna radiator. The circumference of the first portion 751*a* may be spaced a specified distance to be electromagnetically coupled to the antenna radiator.

For example, a second portion 752*a* of the opening 750*a* may be connected (or communicated) to the first portion 751*a* but may be formed to extend toward the bottom-side housing 740*bsa* from the rear housing 740*ra*. At this point, one side of the second portion 752*a* may be opened to the outside space or contact a non-conductive member included in a front housing (not shown). According to another embodiment of the present disclosure, one side of the second portion 752*a* may be opened to the outside space as contacting an interface terminal (for example, a USB terminal) formed in the bottom-side housing 740*bsa*.

Referring to FIG. 7B, an electronic device 700*b* according to another embodiment of the present disclosure is shown. As part of a housing that surrounds the electronic device 700*b*, an upper-side housing 740*usb*, a left-side housing 740*lsb*, and a rear housing 740*rb* are shown in FIG. 7B. For example, a side housing including the upper-side housing 740*usb* and the left-side housing 741*lsb* may be implemented with one configuration by using a conductive material (that is, a metal bezel). Moreover, the rear housing 740*rb* of the electronic device 700*b* may be implemented with a non-conductive member.

According to an embodiment of the present disclosure, an opening 750*b* may be formed at the upper-side housing 740*ub*. For example, a first portion 751*b* of the opening 750*b* may be formed at the upper-side housing 740*usb* but may be formed at a position corresponding to an antenna radiator embedded in the electronic device 700*b*. For example, the length direction of the first portion 751*b* may correspond to the length direction of the antenna radiator. The circumference of the first portion 751*b* may be spaced a specified distance to be electromagnetically coupled to the antenna radiator.

For example, a second portion 752*b* of the opening 750*b* may be connected (or communicated) to the first portion 751*b* on the upper-side housing 740*usb*. At this point, one side of the second portion 752*b* may be opened to the outside space or contact a non-conductive member included in a front housing (not shown).

In general, when the housing of a metallic material is used, due to the electromagnetic shield, the antenna radiation performance of an electronic device may be greatly reduced or impossible. In relation to this, by an antenna structure and an electronic device including the same according to various embodiments of the present disclosure, through an opening with an open one side, the radiation performance (for example, the bandwidth expansion of an operating frequency, the acquisition of an additional operating frequency, and so on) of an antenna may be improved.

By an antenna structure and an electronic device including the same according to various embodiments of the present disclosure, since it is possible that one side of the opening is opened, the circumference of the opening may include an electrical open curve. As the circumference of the opening includes an electrical open curve, the length of the electrical open curve may be enough when it is ¼ of the wavelength of an operating radio wave. Accordingly, in comparison to the case of an electrical closed curve, the electrical closed curve requires the length of ½ of the wavelength of an operating wave radio. Furthermore, since it is possible that the circumference of an open curve becomes shorter, more advanced design language may be provided.

By an antenna structure and an electronic device including the same according to various embodiments of the present disclosure, an internal antenna radiator and the circumference of an opening may be coupled to each other electromagnetically. Accordingly, a connection member (for example, a C-clip) for electrically connecting an internal antenna radiator and the circumference of an opening may become unnecessary and furthermore, an inductive/capacitive component for coupling them additionally may also become unnecessary.

Figure 8:
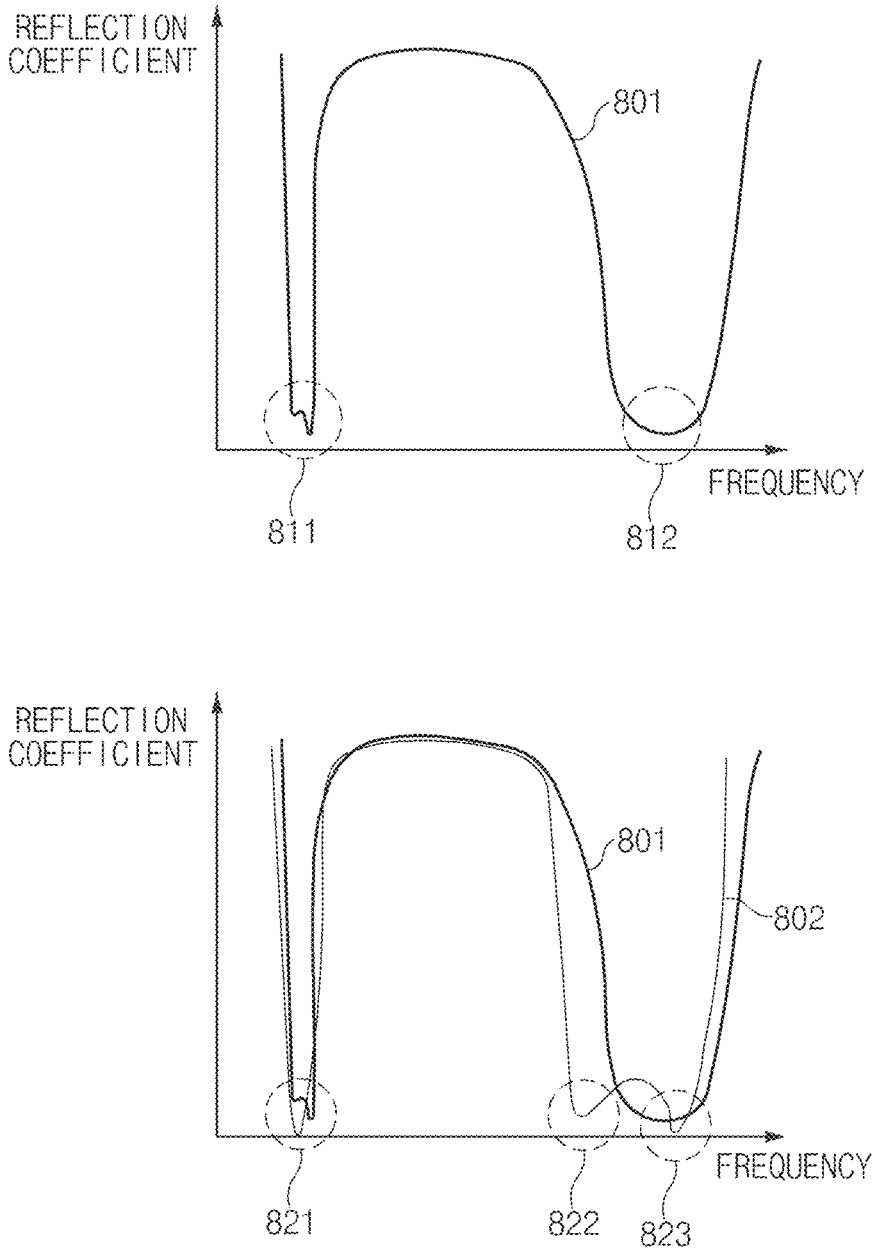
FIG. 8 is a view illustrating a relationship between a frequency by an operation of an electronic device and a reflection coefficient according to an embodiment of the present disclosure.

FIG. 8 is a view illustrating a relationship between a frequency by an operation of an electronic device and a reflection coefficient according to an embodiment of the present disclosure.

Referring to FIG. 8, reflection coefficient graphs according to frequency are shown schematically. In the reflection coefficient graphs, for example, a curve 801 may represent a reflection coefficient curve before the rear housing 540*r* of FIG. 5 is coupled to the electronic device 500 and a curve 802 may represent a reflection coefficient curve after the rear housing 540*r* is coupled to the electronic device 500. For convenience of description, in describing FIG. 8, the reference numerals of FIG. 5 are used together.

Referring to the curve 801, an antenna of the electronic device 500 according to an embodiment of the present disclosure may represent a low reflection coefficient at a low frequency band 811 (for example, 824 MHz and 890 MHz bands) and a high frequency band 812 (for example, 2.49 GHz and 2.69 GHz bands). For example, when the rear housing 540*r* is not coupled to the electronic device 500, an antenna included in the electronic device 500 may resonate in the low frequency band 811 and the high frequency band 812.

According to various embodiments of the present disclosure, referring to the curve 802, an antenna of the electronic device 500 may represent a low reflection coefficient at a low frequency band 821 (for example, 824 MHz and 890 MHz bands), an intermediate frequency band 822 (for example, 1.71 GHz, 1.85 GHz, 1.99 GHz, and 2.11 GHz bands) and a high frequency band 823 (for example, 2.49 GHz and 2.69 GHz bands). For example, when the rear housing 540*r* is coupled to the electronic device 500, an antenna of the electronic device 500 may resonate in the low frequency band 821, the intermediate frequency band 822, and the high frequency band 823.

According to various embodiments of the present disclosure, in the case that the curve 801 and the curve 802 are compared, when the rear housing 540*r* is coupled to the electronic device 500 (in the case of the curve 802), unlike previous coupling (in the case of the curve 801), it may be checked that an additional resonance is obtained in an intermediate frequency band and a high frequency band. That is, in the intermediate frequency band and the high frequency band, a bandwidth of an actual operating frequency may be expanded. This may be understood as a result obtained by coupling between the opening 550 formed at the rear housing 540*r* and the antenna radiator 560.

Figure 9:
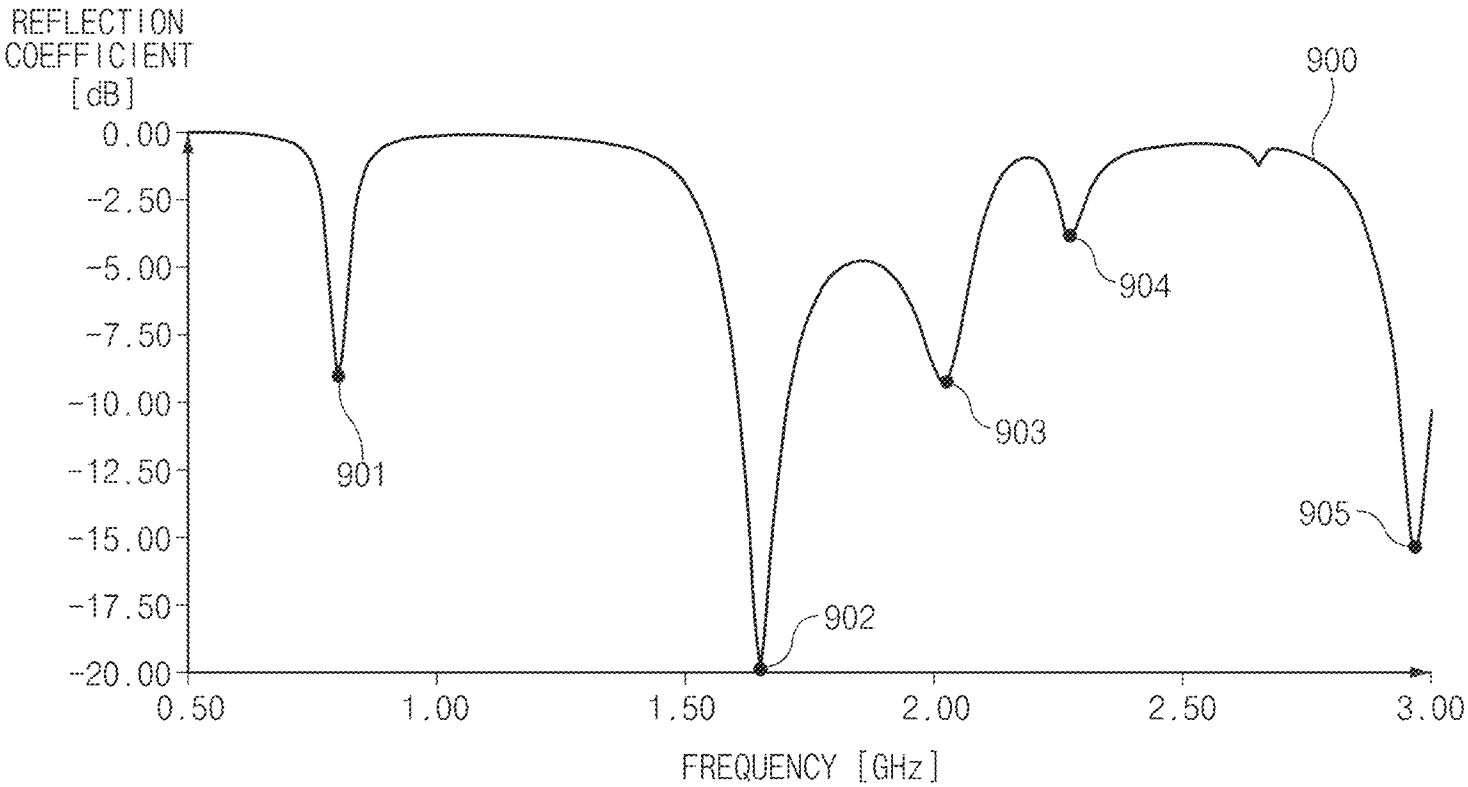
FIG. 9 is a view illustrating a relationship between a frequency by a simulation operation of an electronic device and a reflection coefficient according to an embodiment of the present disclosure.

FIG. 9 is a view illustrating a relationship between a frequency by a simulation operation of an electronic device and a reflection coefficient according to an embodiment of the present disclosure.

Referring to FIG. 9, a reflection coefficient graph (for example, a curve 900) according to a frequency derived through simulation is shown. Referring to the curve 900, when a frequency is 800 MHz (for example, a point 901), a reflection coefficient represents −9.233 dB; when a frequency is 1.65 GHz (for example, a point 902), a reflection coefficient represents −20.018 dB; when a frequency is 2.02 GHz (for example, a point 903), a reflection coefficient represents −9.324 dB; when a frequency is 2.27 GHz (for example, a point 904), a reflection coefficient represents −3.907 dB; and when a frequency is 2.97 GHz (for example, a point 905), a reflection coefficient represents −15.458 dB.

According to various embodiments of the present disclosure, referring to the curve 900, it may be checked that improved antenna radiation efficiency is achieved in the low frequency band 821 (for example, 800 MHz to 900 MHz bands), the intermediate frequency band 822 (for example, 1.6 GHz to 2.2 GHz bands) and the high frequency band 823 (for example, 2.4 GHz to 3.0 GHz bands).

Figure 10A:
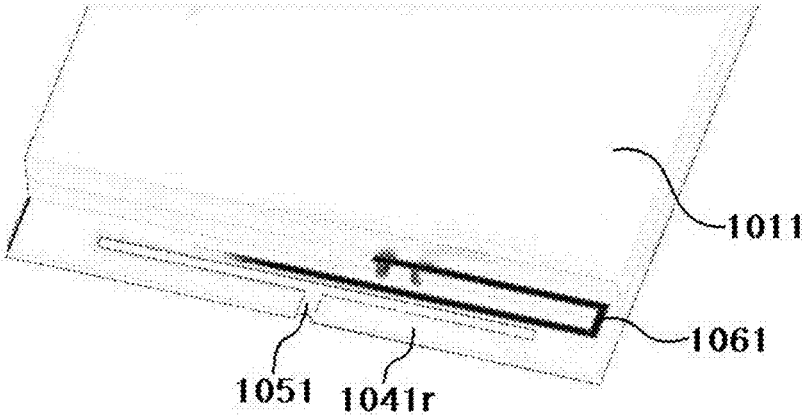
FIGS. 10A to 10C are views illustrating a high frequency structural simulator (HFSS) simulation result of an electronic device where an antenna structure is mounted according to an embodiment of the present disclosure.
Figure 10B:
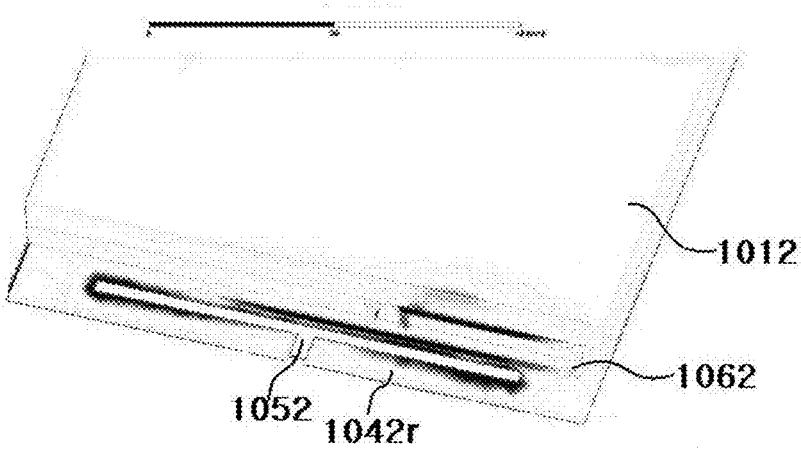
Figure 10C:
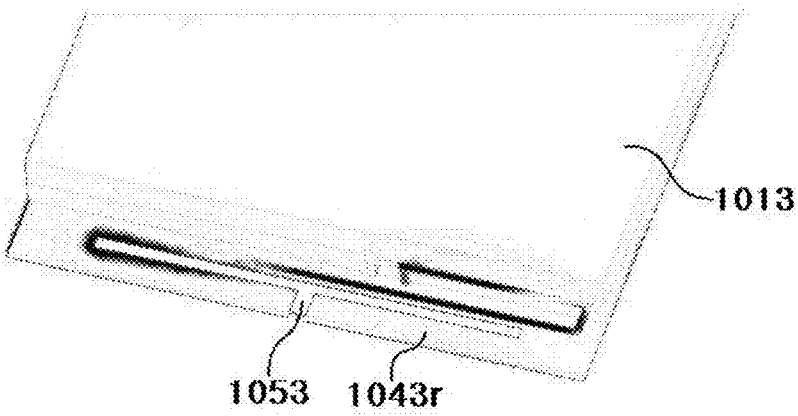

FIGS. 10A to 10C are views illustrating an HFSS simulation of an electronic device where an antenna structure is mounted according to an embodiment of the present disclosure.

Referring to FIGS. 10A to 10C, a result obtained when current density HFSS simulation is performed on electronic devices 1011, 1012, and 1013 is shown according to an embodiment of the present disclosure. For example, each of the electronic devices 1011, 1012, and 1013 may correspond to the electronic device 500 coupled to the rear housing 540*r* of FIG. 5.

The HFSS simulation result of the electronic device 1011 of FIG. 10A, for example, represents a current density (A/m2) when the electronic device 1011 operates at 800 MHz (for example, the point 901 of FIG. 9), and the HFSS simulation result of the electronic device 1012 of FIG. 10B represents a current density when the electronic device 1012 operates at 1.65 GHz (for example, the point 902 of FIG. 9). The HFSS simulation result of the electronic device 1013 of FIG. 10C represents a current density when the electronic device 1012 operates at 2.02 GHz (for example, the point 903 of FIG. 9).

According to various embodiments of the present disclosure, in relation to each HFSS simulation result (for example, current distribution), a high current density area is displayed with dark color and an area other than that is displayed with light color. The radiation of a radio wave may occur actually in a high current density area.

According to various embodiments of the present disclosure, in relation to the HFSS simulation result of the electronic device 1011 of FIG. 10A, the electronic device 1011 may operate at a relatively low frequency (for example, 800 MHz). In this case, a current density may be detected high at an antenna radiator 1061 and a current density is detected very low at the circumference of an opening 1051 formed at a rear housing 1041*r*. That is, when the electronic device 1011 operates at a relatively low frequency (for example, 800 MHz), resonance may be mainly made at the antenna radiator 1061.

According to various embodiments of the present disclosure, in relation to the HFSS simulation result of the electronic device 1012 of FIG. 10B, the electronic device 1012 may operate at an intermediate frequency (for example, 1.65 GHz). In this case, a current density may be detected high at the circumference of an opening 1052 formed at a rear housing 1042*r* and a current density is detected relatively low at an antenna radiator 1062. That is, when the electronic device 1012 operates at an intermediate frequency (for example, 1.65 GHz), resonance may be mainly made at the circumference of the opening 1052 formed at the rear housing 1042*r*.

According to various embodiments of the present disclosure, in relation to the HFSS simulation result of the electronic device 1013 of FIG. 10C, the electronic device 1013 may operate at a relatively high frequency (for example, 2.02 GHz). In this case, a current density may be detected high at the antenna radiator 1063 and is detected relatively low at the circumference of an opening 1053 formed at a rear housing 1043*r*. That is, when the electronic device 1013 operates at a relatively high frequency (for example, 2.02 GHz), resonance may be mainly made at the antenna radiator 1063.

According to the HFSS simulations of FIGS. 10A to 10C, the circumference of an opening formed at a rear housing is electromagnetically coupled to an antenna radiator to perform a similar role to the antenna radiator. For example, due to a 'T' shaped opening formed at the rear housing, a bandwidth may be expanded at an intermediate frequency band (for, example, about 1.65 GHz).

Figure 11:
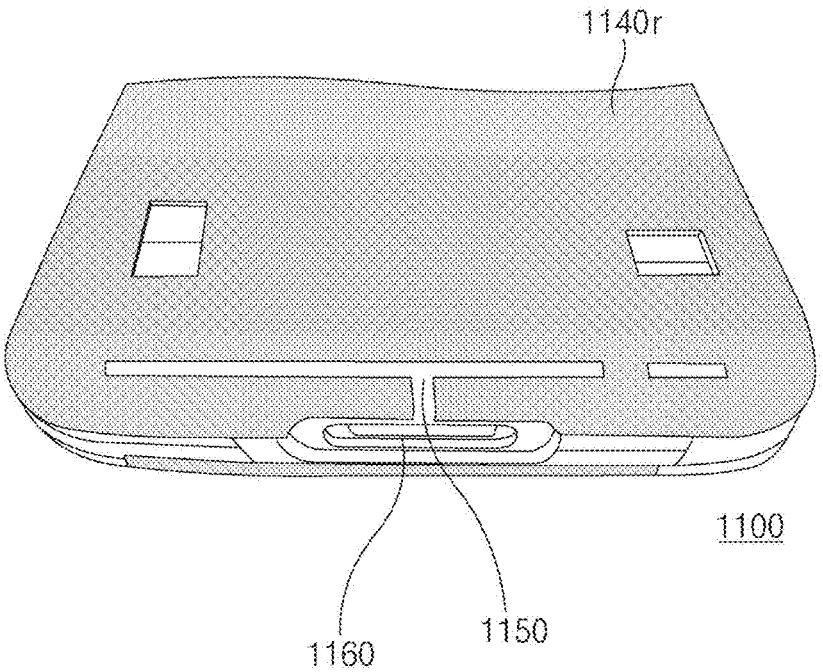
FIG. 11 is a view illustrating an electronic device where an antenna structure is applied according to an embodiment of the present disclosure.

FIG. 11 is a view illustrating an electronic device where an antenna structure is applied according to an embodiment of the present disclosure.

Referring to FIG. 11, an electronic device 1100, for example, may correspond to the electronic device 101 of FIG. 1, the electronic device 201 of FIG. 2, or the electronic device 300 of FIGS. 3A to 3C. According to an embodiment of the present disclosure, a portion of the housing of the electronic device 1100 may be formed of a conductive member. For example, a rear housing 1140*r* formed of a conductive member may be coupled to the rear of the electronic device 1100. An antenna radiator for wireless communication may be disposed in the electronic device 1100.

According to an embodiment of the present disclosure, an opening 1150 may be formed at a lower end of the rear housing 1140*r*. In relation to the inside of the electronic device 1100, an antenna radiator may be disposed at a position corresponding to the opening 1150, and the circumference of the opening 1150 and the antenna radiator may be coupled to each other electrically.

For example, the opening 1150 may include a portion (or a first portion) extending in a first direction (for example, a horizontal direction of the electronic device 1100) of the electronic device 1100 and a portion (or a second portion) extending in a second direction (for example, a vertical direction of the electronic device 1100). For example, the portion extending in the second direction may be formed branching from the portion extending in the first direction, and the first direction and the second direction may be substantially perpendicular to each other. Through this, for example, the opening 1150 may be formed in a 'T' shape.

For example, the portion extending in the first direction may be formed not extending toward the left/right-side housings of the electronic device 1100. Additionally, for example, the portion extending in the second direction is formed to extend toward the bottom-side housing of an electronic device but one side of the portion extending in the second direction may be open to an interface terminal 1160.

Figure 12:
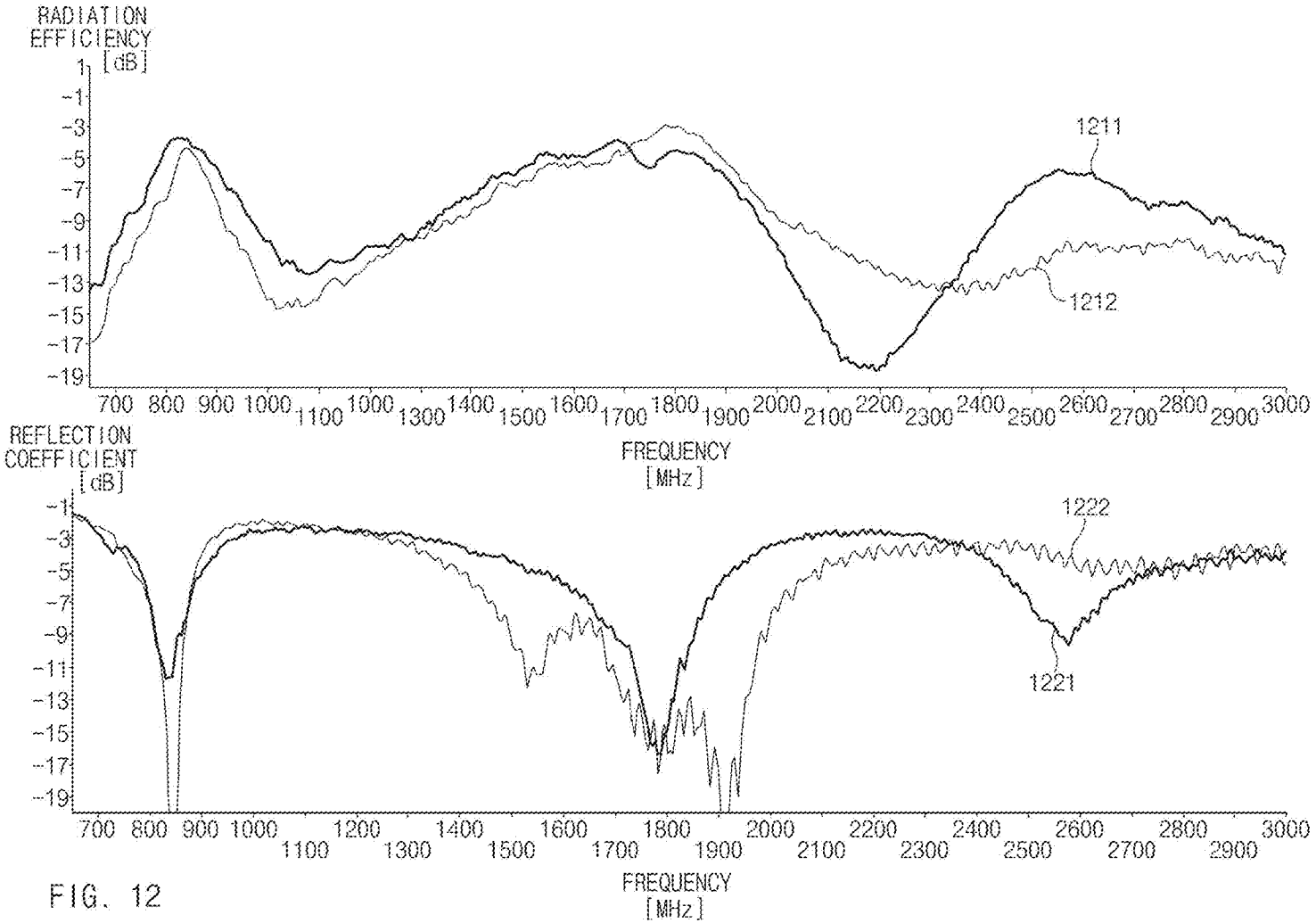
FIG. 12 is a view illustrating a radiation efficiency and a reflection coefficient by an operation of an electronic device according to an embodiment of the present disclosure.

FIG. 12 is a view illustrating a radiation efficiency and a reflection coefficient by an operation of an electronic device according to an embodiment of the present disclosure.

Referring to FIG. 12, a radiation efficiency and a reflection coefficient by an operation of an electronic device are shown according to an embodiment of the present disclosure. For example, each of curves 1211 and 1221 represents a radiation efficiency and a reflection coefficient before the rear housing 1140*r* formed of a conductive member is coupled to the electronic device 1100 of FIG. 11. Additionally, for example, each of curves 1212 and 1222 represents a radiation efficiency and a reflection coefficient after the rear housing 1140*r* is coupled to the electronic device 1100 of FIG. 11.

Referring to the curves 1212 and 1222, in a low frequency band (for example, approximately around 850 MHz), by comparing the curves 1211 and 1221, it is checked that radiation efficiency is similar but a reflection coefficient is improved. Additionally, in an intermediate frequency band (for example, approximately 1.5 GHz to 2.0 GHz bands), by comparing the curves 1211 and 1221, it is checked that a frequency band is expanded. In a high frequency band (for example, 2.1 GHz to 2.4 GHz bands), it is checked that radiation efficiency is improved.

Figure 13:
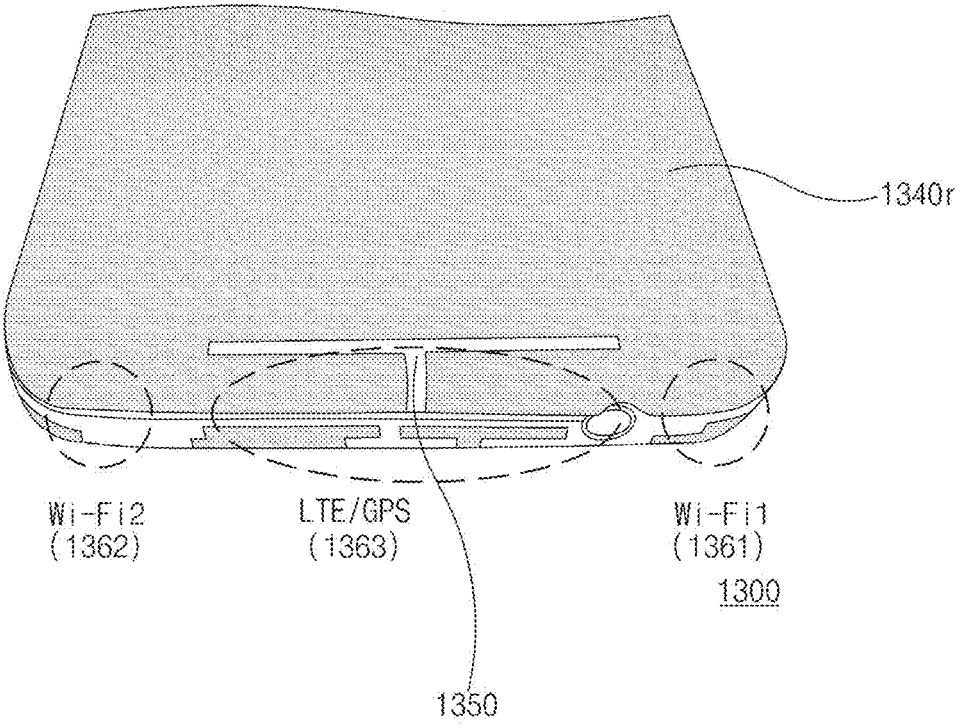
FIG. 13 is a view illustrating an electronic device where an antenna structure is applied according to another embodiment of the present disclosure.

FIG. 13 is a view illustrating an electronic device where an antenna structure is applied according to another embodiment of the present disclosure.

Referring to FIG. 13, an electronic device 1300, for example, may correspond to the electronic device 101 of FIG. 1, the electronic device 201 of FIG. 2, or the electronic device 300 of FIGS. 3A to 3C. For another example, the electronic device 1300 may correspond to the electronic device 1100 of FIG. 11. If the electronic device 1300 of FIG. 13 corresponds to the electronic device 1100 of FIG. 11, an opening may be formed at a plurality of positions.

According to an embodiment of the present disclosure, a rear housing 1340*r* formed of a conductive member may be coupled to the rear of the electronic device 1300. According to an embodiment of the present disclosure, an opening 1350 may be formed at an upper end of the rear housing 1340*r*. For example, in relation to the inside of the electronic device 1300, at least one radiator may be disposed at a position corresponding to the opening 1350. The circumference of the opening 1350 and the antenna radiator may be electrically coupled to each other.

For example, the at least one antenna radiator may include a first Wi-Fi radiator (Wi-Fi1) 1361, a second Wi-Fi radiator (Wi-Fi2) 1362, and/or an LTE/GPS radiator (LTE/GPS) 1363. A multiple-input multiple-output (MIMO) antenna may be implemented by the at least one antenna radiator.

Figure 14:
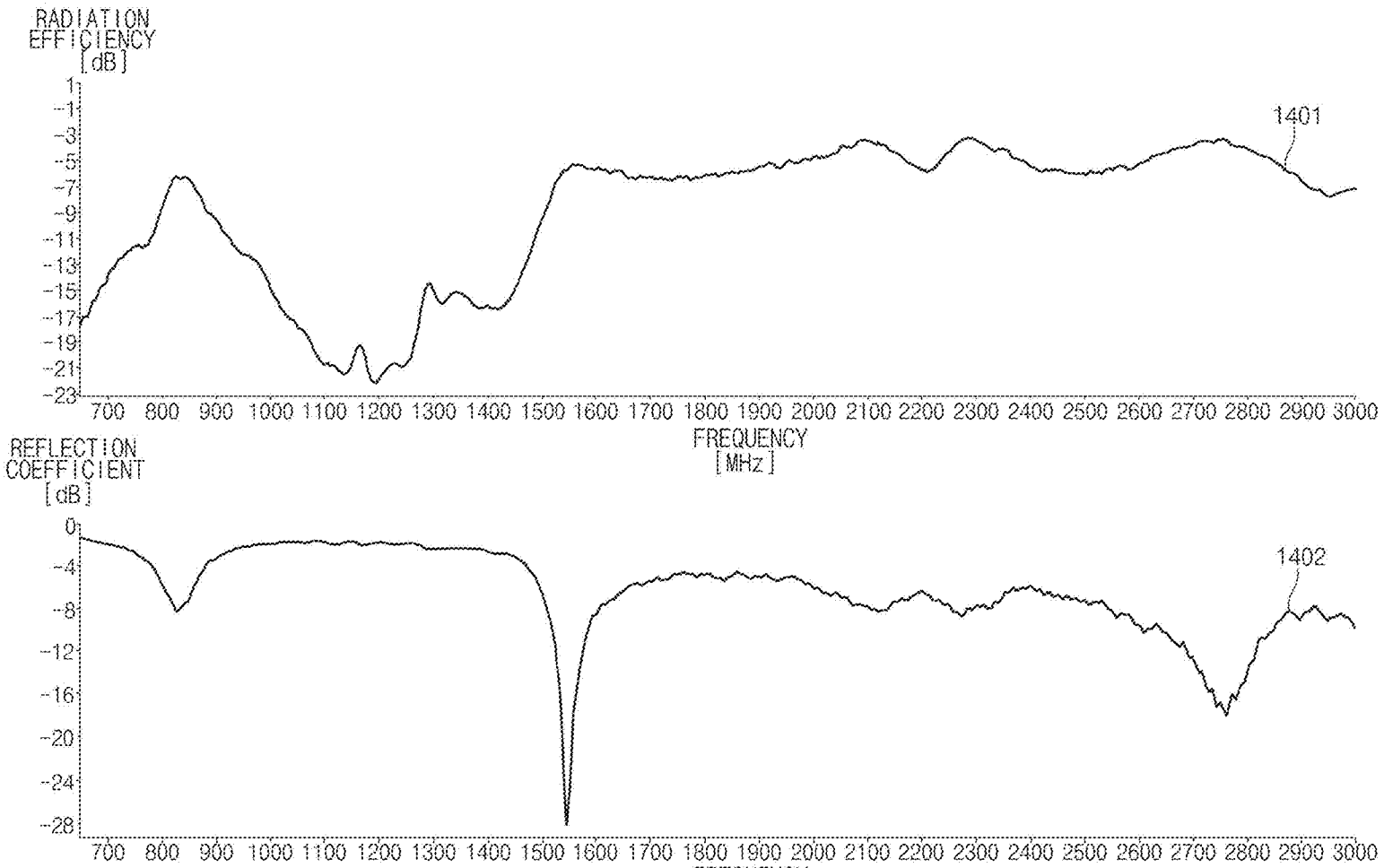
FIG. 14 is a view illustrating a radiation efficiency and a reflection coefficient by an operation of an electronic device according to another embodiment of the present disclosure.

FIG. 14 is a view illustrating a radiation efficiency and a reflection coefficient by an operation of an electronic device according to another embodiment of the present disclosure.

Referring to FIG. 14, a radiation efficiency graph (for example, a curve 1401) and a reflection coefficient graph (for example, a curve 1402) of the second LTE/GPS radiator (LTE/GPS) shown in FIG. 13 are shown.

Referring to the curve 1401, it is checked that the performance of radiation efficiency is improved in a low frequency band (approximately around 850 MHz), an intermediate frequency band (approximately 1.5 GHz to 2.0 GHz bands) and a high frequency band (approximately 2.1 GHz to 2.4 GHz bands). Additionally, referring to the curve 1402, it is checked that the reflection coefficient is improved in a low frequency band (approximately around 850 MHz), an intermediate frequency band (approximately about 1.55 GHz) and a high frequency band (approximately about 2.77 GHz).

Figure 15:
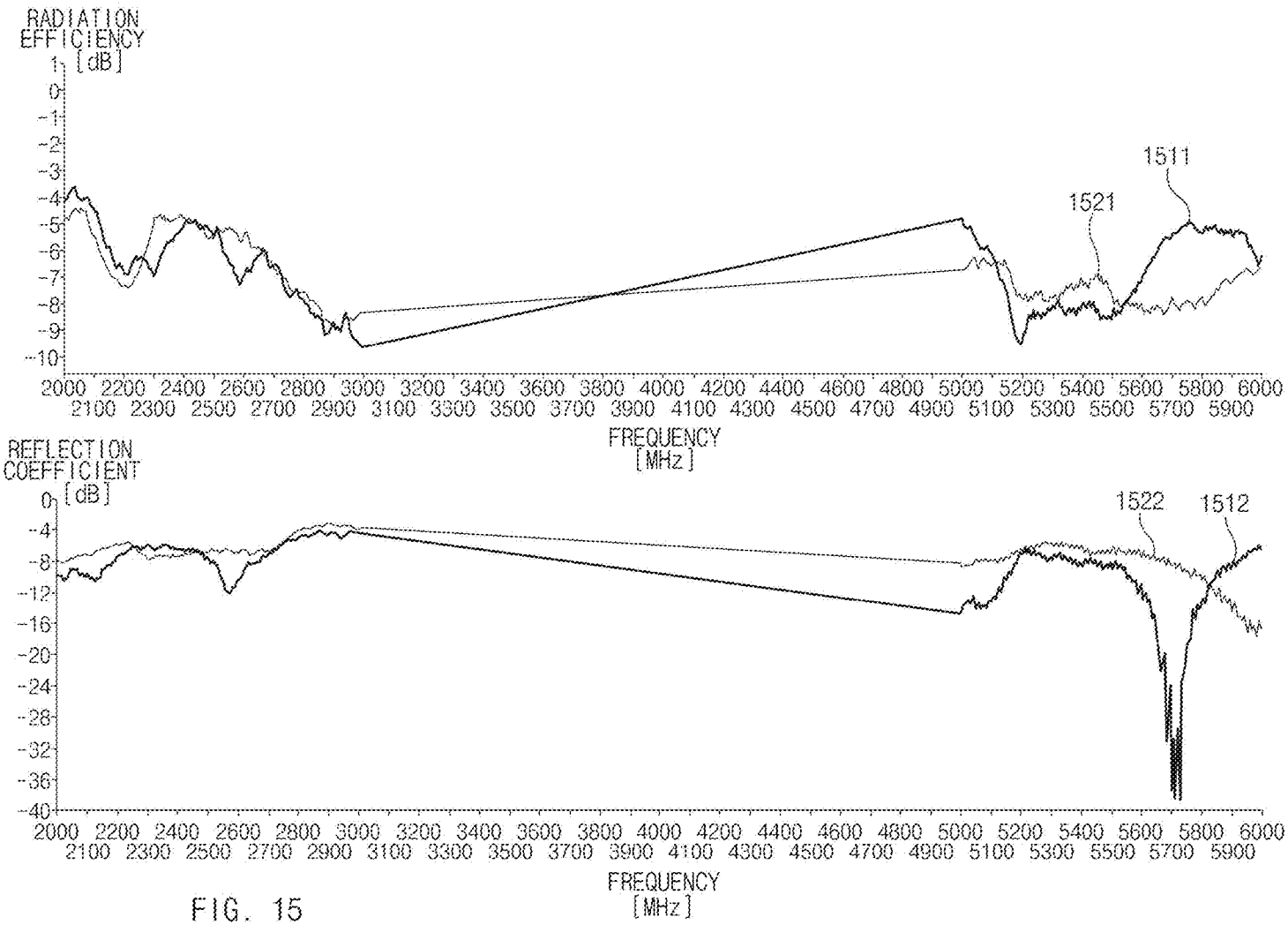
FIG. 15 is a view illustrating a radiation efficiency and a reflection coefficient by an operation of an electronic device according to another embodiment of the present disclosure.

FIG. 15 is a view illustrating a radiation efficiency and a reflection coefficient by an operation of an electronic device according to another embodiment of the present disclosure.

Referring to FIG. 15, a radiation efficiency graph (for example, curves 1511 and 1521) and a reflection coefficient graph (for example, curves 1512 and 1522) by a Wi-Fi MIMO antenna radiator are shown. The Wi-Fi MIMO antenna radiator, for example, may be configured with the first Wi-Fi radiator Wi-Fi1 and the second Wi-Fi radiator Wi-Fi2 shown in FIG. 13.

For example, the curve 1511 and the curve 1512 may correspond to a radiation efficiency graph and a reflection coefficient graph of the first Wi-Fi radiator Wi-Fi1, respectively. For example, the curve 1521 and the curve 1522 may correspond to a radiation efficiency graph and a reflection coefficient graph of the second Wi-Fi radiator Wi-Fi2, respectively.

According to the curve 1511 and the curve 1512, it is checked that the first Wi-Fi radiator Wi-Fi1 and the second Wi-Fi radiator Wi-Fi2 show high radiation efficiency in 2.1 GHz, 2.4 GHz, 5.0 GHz, and 5.7 GHz bands. According to the curve 1512 and the curve 1522, it is checked that in relation to the first Wi-Fi radiator Wi-Fi1 and the second Wi-Fi radiator Wi-Fi2, a reflection coefficient is improved in 2.6 GHz and 5.7 GHz bands and a frequency band is expanded.

According to an embodiment of the present disclosure, an electronic device may include a housing and an antenna radiator disposed in the housing. An opening may be formed in the housing. The opening may be formed to align with the length direction of the antenna radiator at a position corresponding to the antenna radiator, and may include a first portion that penetrates the housing in the thickness direction, and a second portion that is connected to the first portion and is formed in a direction forming a specified angle with respect to the length direction of the antenna radiator and penetrates the housing in the thickness direction. At least a portion of the housing, which surrounds the opening, may be formed of a conductive member and at least a portion of the circumference of the opening may include an electrical open curve.

In relation to an electronic device according to another embodiment of the present disclosure, the opening may be at least formed in the rear housing of the electronic device.

In relation to an electronic device according to another embodiment of the present disclosure, at least one of the first portion and the second portion may be formed in an oblong shape.

In relation to an electronic device according to another embodiment of the present disclosure, the first portion may be formed to not extend toward the left/right-side housing of the electronic device. That is the first portion is formed in a one of a rear housing, an upper-side housing, and bottom-side housing.

In relation to an electronic device according to another embodiment of the present disclosure, the second portion may be formed to extend toward one of the upper-side housing and the bottom-side housing of the electronic device.

In relation to an electronic device according to another embodiment of the present disclosure, the second portion may be formed to extend toward one periphery of the housing of the electronic device.

In relation to an electronic device according to another embodiment of the present disclosure, when one end of the second portion is connected to the first portion and the second portion is formed in a direction that forms 90 degrees with respect to the first portion, the first portion and the second portion may together form a T shape.

In relation to an electronic device according to another embodiment of the present disclosure, the antenna radiator may be spaced a specified distance apart from the opening of the housing, and at least a portion of the housing, which is formed of the conductive member, may be electromagnetically coupled to the antenna radiator at the circumference of the opening.

In relation to an electronic device according to another embodiment of the present disclosure, the length of the electrical open curve may be determined based on a specified wavelength.

In relation to an electronic device according to another embodiment of the present disclosure, the opening may be filled with a dielectric member.

An electronic device according to an embodiment of the present disclosure may include an external housing that includes a first surface and a second surface facing the opposite direction of the first surface, a conductive member that forms at least a portion of the first surface of the external housing, an antenna radiator that is disposed in the external housing and spaced apart from the conductive member, and an opening that is formed by penetrating at least a portion of the conductive member. The opening may include a first portion that is configured to substantially align with at least a portion of the antenna radiator and a second portion configured to be substantially perpendicular to the first portion. The second portion may extend from a portion of the first portion toward the vicinity (e.g., adjacency) of one of one side of the conductive member.

In relation to an electronic device according to another embodiment of the present disclosure, the opening may include a T shape.

In relation to an electronic device according to another embodiment of the present disclosure, a non-conductive material for filling at least a portion of the opening may be further included.

In relation to an electronic device according to another embodiment of the present disclosure, the conductive member may be disposed above a battery which is mounted in the external housing.

In relation to an electronic device according to another embodiment of the present disclosure, the external housing further includes a third surface interposed between the first surface and the second surface, and at least a portion of a display may be disposed at the third surface of the external housing.

In relation to an electronic device according to another embodiment of the present disclosure, at least a portion of a display may be disposed on at least a portion of the first surface of the external housing.

In relation to an electronic device according to another embodiment of the present disclosure, the display may be configured to pass the extended third surface to a location between the first surface and the second surface, from the second surface, of the external housing and connect to at least a portion of the first surface.

In relation to an electronic device according to another embodiment of the present disclosure, the conductive member may extend from at least a portion of the first surface of the external housing to at least a portion of the third surface.

An electronic device according to another embodiment of the present disclosure may further include another opening formed by penetrating at least another portion of the conductive member, and at least one electronic component mounted in the housing may be exposed to the outside through the another opening.

In relation to an electronic device according to another embodiment of the present disclosure, the antenna radiator may form at least a portion of an inverted-F antenna.

Figure 16:
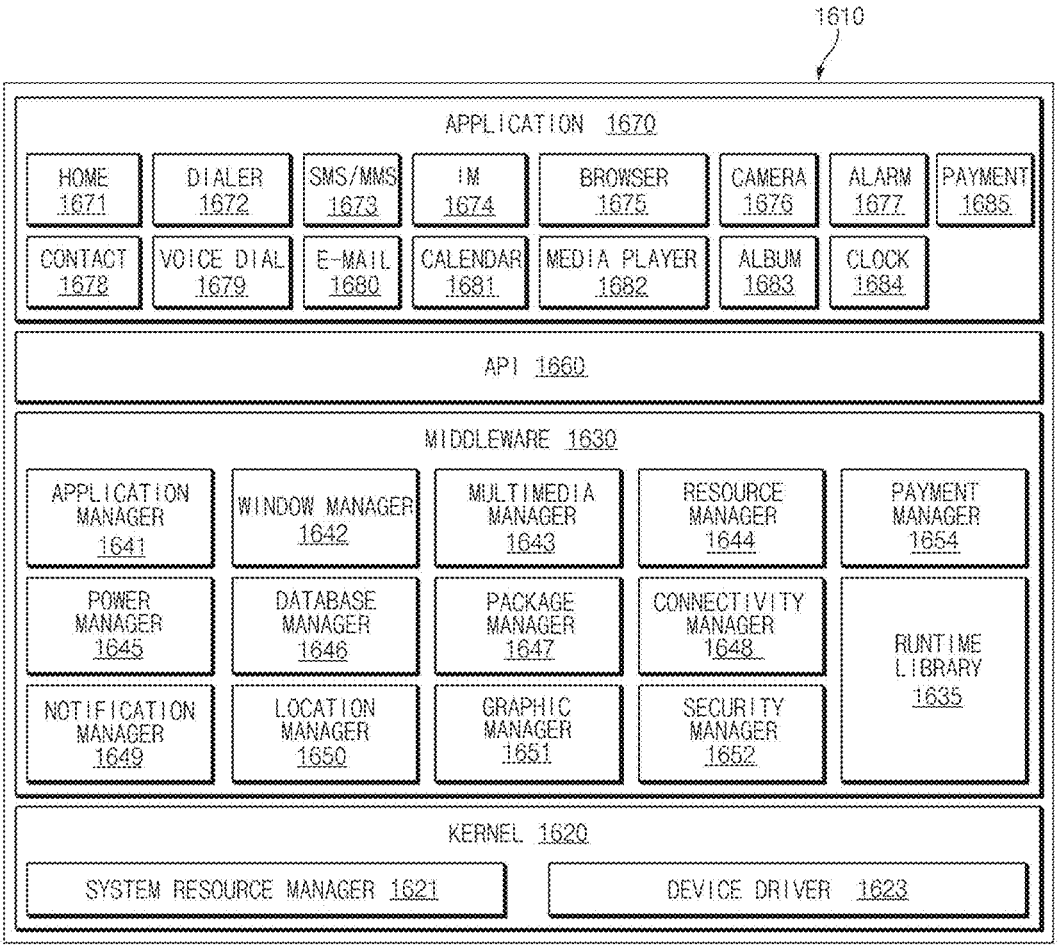
FIG. 16 is a block diagram illustrating a program module according to various embodiments of the present disclosure.

FIG. 16 is a block diagram illustrating a program module according to various embodiments of the present disclosure.

Referring to FIG. 16, a program module 1610 (for example, the program 140) may include an OS for controlling a resource relating to an electronic device (for example, the electronic device 101) and/or various applications (for example, the application 147) running on the OS. The OS, for example, may include android, iOS, windows, symbian, tizen, or bada.

The program module 1610 may include a kernel 1620, a middleware 1630, an API 1660, and/or an application 1670. At least part of the program module 1610 may be preloaded on an electronic device or may be downloaded from an external electronic device (for example, the first or second external electronic device 102 or 104 or the server 106).

The kernel 1620 (for example, the kernel 141), for example, may include a system resource manager 1621 and/or a device driver 1623. The system resource manager 1621 may perform the control, allocation, or retrieval of a system resource. According to an embodiment of the disclosure, the system resource manager 1621 may include a process management unit, a memory management unit, or a file system management unit. The device driver 1623, for example, may include a display driver, a camera driver, a BT driver, a sharing memory driver, a USB driver, a keypad driver, a Wi-Fi driver, an audio driver, or an inter-process communication (IPC) driver.

The middleware 1630, for example, may provide a function that the application 1670 requires commonly, or may provide various functions to the application 1670 through the API 1660 in order to allow the application 1670 to efficiently use a limited system resource inside the electronic device. According to an embodiment, the middleware 1630 (for example, the middleware 143) may include at least one of a runtime library 1635, an application manager 1641, a window manager 1642, a multimedia manager 1643, a resource manager 1644, a power manager 1645, a database manager 1646, a package manager 1647, a connectivity manager 1648, a notification manager 1649, a location manager 1650, a graphic manager 1651, a security manager 1652, and a payment manager 1654.

The runtime library 1635, for example, may include a library module that a complier uses to add a new function through a programming language while the application 1670 is running. The runtime library 1635 may perform a function on input/output management, memory management, or an arithmetic function.

The application manager 1641, for example, may mange the life cycle of at least one application among the application 1670. The window manager 1642 may manage a GUI resource used in a screen. The multimedia manager 1643 may recognize a format for playing various media files and may encode or decode a media file by using the codec corresponding to a corresponding format. The resource manager 1644 may manage a resource such as a source code, a memory, or a storage space of at least any one of the application 1670.

The power manager 1645, for example, may operate together with a basic input/output system (BIOS) to manage the battery or power and may provide power information necessary for an operation of the electronic device. The database manager 1646 may generate, search, or modify a database used in at least one application among the application 1670. The package manager 1647 may manage the installation or update of an application distributed in a package file format.

The connectivity manger 1648 may manage a wireless connection such as Wi-Fi or BT. The notification manager 1649 may display or notify an event such as arrival messages, appointments, and proximity alerts to a user in a manner of not interrupting the user. The location manager 1650 may manage location information on an electronic device. The graphic manager 1651 may manage a graphic effect to be provided to a user or a user interface relating thereto. The security manager 1652 may provide various security functions necessary for system security or user authentication. According to an embodiment, when an electronic device (for example, the electronic device 101) includes a phone function, the middleware 1630 may further include a telephony manager for managing a voice or video call function of the electronic device.

The middleware 1630 may include a middleware module forming a combination of various functions of the above-mentioned components. The middleware 1630 may provide a module specialized for each type of OS to provide differentiated functions. Additionally, the middleware 1630 may delete part of existing components or add new components dynamically.

The API 1660 (for example, the API 145), for example, as a set of API programming functions, may be provided as another configuration according to OS. For example, in the case of android or iOS, one API set may be provided for each platform and in the case Tizen, at least two API sets may be provided for each platform.

The application 1670 (for example, the application 147) may include at least one application for providing functions such as a home 1671, a dialer 1672, an short message service (SMS)/multimedia messaging service (MMS) 1673, an instant message (IM) 1674, a browser 1675, a camera 1676, an alarm 1677, a contact 1678, a voice dial 1679, an e-mail 1680, a calendar 1681, a media player 1682, an album 1683, a clock 1684, a payment 1685, a health care provision (for example, measure an exercise amount or blood sugar) (not shown), and an environmental information provision (for example, provide air pressure, humidity, or temperature information) (not shown).

According to an embodiment, the application 1670 may include an application (hereinafter referred to as "information exchange application") for supporting information exchange between the electronic device (for example, the electronic device 101) and an external electronic device (for example, the first or second external electronic device 102 or 104). The information exchange application, for example, may include a notification relay application for relaying specific information to the external device or a device management application for managing the external electronic device.

For example, the notification relay application may have a function for relaying to an external electronic device (for example, first and second external electronic devices 102 and 104) notification information occurring from another application (for example, an SMS/MMS application, an e-mail application, a health care application, or an environmental information application) of the electronic device. Additionally, the notification relay application may receive notification information from an external electronic device and may then provide the received notification information to a user.

The device management application, for example, may manage (for example, install, delete, or update) at least one function (turn-on/turn off of the external electronic device itself (or some components) or the brightness (or resolution) adjustment of a display) of an external electronic device (for example, the first and second external electronic devices 102 and 104) communicating with the electronic device, an application operating in the external electronic device, or a service (for example, call service or message service) provided from the external device.

According to an embodiment of the disclosure, the application 1670 may include a specified application (for example, a health care application of a mobile medical device) according to the property of an external electronic device (for example, the first or second external electronic device 102 or 104). According to an embodiment, the application 1670 may include an application received from an external electronic device (for example, the server 106 or the first or second external electronic device 102 or 104). According to an embodiment of the disclosure, the application 1670 may include a preloaded application or a third party application downloadable from a server. The names of components in the program module 1610 according to the shown embodiment may vary depending on the type of OS.

According to various embodiments of the present disclosure, at least part of the program module 1610 may be implemented with software, firmware, hardware, or a combination thereof. At least part of the program module 1610, for example, may be implemented (for example, executed) by a processor (for example, the processor 210). At least part of the program module 1610 may include a module, a program, a routine, sets of instructions, or a process to perform at least one function, for example.

By an antenna structure and an electronic device including the same according to various embodiments of the present disclosure, as at least a portion of an opening opened to the outside is formed at a housing, even if a housing formed of a conductive member is adopted, antenna radiation performance may be obtained.

According to an embodiment of the present disclosure, since it is possible that a portion of the opening formed at the housing is opened to the outside, the circumference of the opening may include an electrical open curve. At this point, since it is possible that the length of the electrical open curve is enough when it is ¼ of the wavelength of an operating radio wave, in comparison to an electrical closed curve that requires the length of ½ of the wavelength of an operating radio wave, the size of an opening may be further minimized.

Effects obtainable from various embodiments of the present disclosure are not limited to the above-mentioned effects, and other effects not mentioned above may be clearly derived and understood to those skilled in the art from the following description.

The term "module" used in various embodiments of the present disclosure, for example, may mean a unit including a combination of at least one of hardware, software, and firmware. The term "module" and the term "unit," "logic," "logical block," "component," or "circuit" may be interchangeably used. A "module" may be a minimum unit or part of an integrally configured component. A "module" may be a minimum unit performing at least one function or part thereof. A "module" may be implemented mechanically or electronically. For example, "module" according to various embodiments of the present disclosure may include at least one of an application-specific integrated circuit (ASIC) chip performing certain operations, field-programmable gate arrays (FPGAs), or a programmable-logic device, all of which are known or to be developed in the future.

According to various embodiments of the present disclosure, at least part of a device (for example, modules or functions thereof) or a method (for example, operations) according to this disclosure, for example, as in a form of a programming module, may be implemented using an instruction stored in computer-readable storage media. When at least one processor (for example, the processor 120 of FIG. 1) executes an instruction, it may perform a function corresponding to the instruction. The non-transitory computer-readable storage media may include the memory 130 shown in FIG. 1, for example.

The non-transitory computer-readable storage media may include hard disks, floppy disks, magnetic media (for example, magnetic tape), optical media (for example, compact disc (CD)-ROM, and DVD), magneto-optical media (for example, floptical disk), and hardware devices (for example, ROM, RAM, or flash memory). Additionally, a program instruction may include high-level language code executable by a computer using an interpreter in addition to machine code created by a complier. The hardware device may be configured to operate as at least one software module to perform an operation of various embodiments of the present disclosure and vice versa.

A module or a programming module according to various embodiments of the present disclosure may include at least one of the above-mentioned components, may not include some of the above-mentioned components, or may further include another component. Operations performed by a module, a programming module, or other components according to various embodiments of the present disclosure may be executed through a sequential, parallel, repetitive or heuristic method. Additionally, some operations may be executed in a different order or may be omitted. Or, other operations may be added.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a housing forming an appearance of the electronic device; and an antenna radiator disposed in an internal space formed by the housing, wherein an opening is formed in the housing and is spaced a distance apart from a position corresponding to the antenna radiator, wherein the opening comprises:

a first portion configured to:

align with a length direction of the antenna radiator at a position corresponding to the antenna radiator, and penetrate the housing in a thickness direction; and a second portion connected to the first portion, the second portion being configured to:

form a specified angle with respect to the length direction of the antenna radiator, and penetrate the housing in the thickness direction, wherein at least a portion of the housing, which surrounds the opening, comprises a conductive member, and wherein at least a portion of a circumference of the opening comprises an electrical open curve.

2. The electronic device of claim 1, wherein the opening is at least formed in a rear housing of the electronic device.

3. The electronic device of claim 1, wherein at least one of the first portion and the second portion is formed to comprise an oblong shape.

4. The electronic device of claim 1, wherein the first portion is formed in a one of a rear housing, an upper-side housing, and bottom-side housing.

5. The electronic device of claim 1, wherein the second portion is formed to expand toward one of an upper-side housing and a bottom-side housing of the electronic device.

6. The electronic device of claim 1, wherein the second portion is formed to expand toward one side periphery of the housing of the electronic device.

7. The electronic device of claim 1, wherein, when one end of the second portion is connected to the first portion and the second portion is configured to be perpendicular with respect to the first portion, the first portion and the second portion together form a "T" shape.

8. The electronic device of claim 1, wherein at least a portion of the housing, which is formed of the conductive member, is electromagnetically coupled to the antenna radiator at the circumference of the opening.

9. The electronic device of claim 1, wherein a length of the electrical open curve is determined based on a specified wavelength.

10. The electronic device of claim 1, wherein the opening is filled with a dielectric member.

11. An electronic device comprising:

an external housing forming an appearance of the electronic device, and including a first surface and a second surface facing an opposite direction of the first surface;

a conductive member forming at least a portion of the first surface of the external housing;

an antenna radiator disposed in an internal space formed by the external housing and spaced apart from the conductive member; and an opening formed by penetrating at least a portion of the conductive member, wherein the opening comprises:

a first portion configured to substantially align with at least a portion of the antenna radiator; and a second portion configured to be substantially perpendicular to the first portion, wherein the second portion extends from a portion of the first portion to an adjacency of one of a periphery of the conductive member.

12. The electronic device of claim 11, wherein the opening is formed to comprise a "T" shape.

13. The electronic device of claim 11, further comprising a non-conductive material filling at least a portion of the opening.

14. The electronic device of claim 11, wherein the conductive member is disposed above a battery mounted in the external housing.

15. The electronic device of claim 11, wherein the external housing further comprises a third surface interposed between the first surface and the second surface, and wherein a portion of a display is disposed on the third surface of the external housing.

16. The electronic device of claim 11, wherein at least a portion of a display is disposed on at least a portion of the first surface of the external housing.

17. The electronic device of claim 16, wherein the display is configured to:

pass a third surface to a location between the first surface and the second surface, from the second surface, of the external housing, and connect to at least the portion of the first surface.

18. The electronic device of claim 17, wherein the conductive member extends from at least a portion of the first surface of the external housing to at least a portion of the third surface.

19. The electronic device of claim 11, wherein the electronic device further comprises another opening formed by penetrating at least another portion of the conductive member, and wherein at least one electronic component included in the housing is exposed to the outside through the other opening.

20. The electronic device of claim 11, wherein the antenna radiator is configured to form at least a portion of an inverted-F antenna.

* * * * *